US007946003B2

(12) United States Patent
Sprague et al.

(10) Patent No.: US 7,946,003 B2
(45) Date of Patent: May 24, 2011

(54) PACKAGE CLOSURE AND METHOD

(75) Inventors: Paul Adam Sprague, Kiel, WI (US); Peter John Boulanger, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 1241 days.

(21) Appl. No.: 11/589,449

(22) Filed: Oct. 30, 2006

(65) Prior Publication Data

US 2007/0116386 A1 May 24, 2007

Related U.S. Application Data

(60) Provisional application No. 60/732,376, filed on Nov. 1, 2005.

(51) Int. Cl.

| | |
|---|---|
| ***B65D 33/16*** | (2006.01) |
| ***B65D 33/25*** | (2006.01) |
| ***A44B 19/16*** | (2006.01) |
| ***A44B 19/00*** | (2006.01) |

(52) U.S. Cl. ..... 24/399; 24/30.5 R; 24/585.12; 383/64

(58) Field of Classification Search ..... 24/585.1, 24/585.12, 399, 400, 30.5 R, 425, 427, 435; 383/64, 65

See application file for complete search history.

(56) References Cited

U.S. PATENT DOCUMENTS

| | | | |
|---|---|---|---|
| 3,808,649 | A | 5/1974 | Ausnit |
| 4,744,674 | A | 5/1988 | Nocek |
| 4,791,710 | A | 12/1988 | Nocek et al. |
| 4,925,316 | A | 5/1990 | Van Erden et al. |
| 4,964,739 | A | 10/1990 | Branson et al. |
| 5,794,315 | A | 8/1998 | Crabtree et al. |
| 6,004,032 | A | 12/1999 | Kapperman et al. |
| 6,088,887 | A | 7/2000 | Bois |
| 6,461,042 | B1 | 10/2002 | Tomic et al. |
| 6,609,827 | B2 | 8/2003 | Bois et al. |

(Continued)

FOREIGN PATENT DOCUMENTS

| | | |
|---|---|---|
| FR | 1 304 903 | 9/1962 |

(Continued)

OTHER PUBLICATIONS

International Search Report mailed Mar. 15, 2007.

*Primary Examiner* — Robert J Sandy

(74) *Attorney, Agent, or Firm* — Merchant & Gould P.C.

(57) ABSTRACT

A reclosable tamper-evident package is opened and closed repeatedly by opening and closing a first closure of a package, and when it is desired to close the package and provide an indication of further opening, a second closure is closed that cannot readily be opened. The tamper evident package has a closure assembly that includes a zipper closure arrangement with a slider device. In one embodiment, the slider device is movable between a first axial position and a second axial position. When the slider device is in the first axial position, moving the slider device laterally along the zipper closure arrangement in a first direction closes the first closure. When the slider device is in the second axial position, moving the slider device laterally along the zipper closure arrangement in a first direction closes both the first closure and the second closure. A method of using a package includes grasping a slider device and moving the slider device laterally in a first direction to close the first closure and to permanently close the second closure.

24 Claims, 26 Drawing Sheets

U.S. PATENT DOCUMENTS

| | | | | |
|---|---|---|---|---|
| 6,739,755 | B2 | 5/2004 | Schreiter | |
| 6,761,481 | B1 | 7/2004 | Bois | |
| 6,915,546 | B2 | 7/2005 | Kasai | |
| 7,496,992 | B2 * | 3/2009 | Ausnit | 24/415 |
| 2004/0010893 | A1 | 1/2004 | Kasai | |
| 2004/0045138 | A1 | 3/2004 | Kasai | |
| 2004/0091185 | A1 | 5/2004 | Shibata | |
| 2004/0184681 | A1 | 9/2004 | Arnell | |
| 2004/0234173 | A1 | 11/2004 | Saad et al. | |
| 2005/0025392 | A1 | 2/2005 | Stolmeier | |
| 2005/0235467 | A1 | 10/2005 | Brochardt et al. | |
| 2006/0210201 | A1 * | 9/2006 | Ackerman et al. | 383/64 |

FOREIGN PATENT DOCUMENTS

| | | |
|---|---|---|
| JP | 2004083068 | 3/2004 |
| WO | 00/64766 | 11/2000 |

* cited by examiner

PACKAGE CLOSURE AND METHOD

This application claims priority under 35 U.S.C. §119(e) to U.S. provisional patent application Ser. No. 60/732,376 filed Nov. 1, 2005. The complete disclosure of application 60/732,376 is incorporated herein by reference.

TECHNICAL FIELD

The present disclosure relates generally to closure arrangements for packages, and, in particular, to a closure arrangement for recloseable tamper-evident packages, and methods of using tamper-evident packages.

BACKGROUND

Reclosable packages are convenient because they can be closed and sealed to preserve and contain the enclosed contents. Reclosable packages are also advantageous because they may be opened and closed multiple times. However, in certain applications such as where it is desired to maintain the security and integrity of the contents of the package, it may be desired that a reclosable package be capable of being opened and closed multiple times, and also be capable of being closed in such a way that it cannot be readily opened again. In this way, the package is tamper-evident because it cannot be opened again without being damaged. For example, it may be desired to place evidence for use in a legal proceeding in a package. This may require opening and closing the package multiple times to deposit contents into the package, and when it is desired that the contents no longer be accessed, then closing the package in a manner that prevents the evidence contained within from being accessed or tampered with without damaging the package. Similarly, it may be desired to place cash or financial instruments in a package where the package is capable of being opened and closed multiple times before being closed in a manner that prevents reopening without damaging the package. Other applications for security packages exist.

Consequently, a need exists for a package that can be opened and closed multiple times, and can be closed in such a way that the package cannot readily be re-opened.

SUMMARY

In one aspect, there is disclosed a closure assembly for use with a flexible package that has a zipper closure arrangement having first and second zipper profiles constructed and arranged to selectively interlock, where the zipper closure arrangement includes first and second closures defined by the first and second zipper profiles. The closure assembly also includes a slider device that is oriented to slide laterally along the zipper closure arrangement and is oriented to be axially moveable from a first axial position to a second axial position. The first closure defined by the first zipper profile is constructed and arranged to mate when the slider device is in the first axial position and is moved laterally along the zipper closure arrangement in a first direction. The second closure defined by the second zipper profile is constructed and arranged to mate when the slider device is in the second axial position and is moved laterally along the zipper closure arrangement in the first direction, and when the slider device is in the first axial position, the second closure is constructed and arranged not to mate.

In another aspect, a zipper closure arrangement is disclosed that includes first and second zipper profiles constructed and arranged to selectively interlock and that define first and second closures. The first closure is constructed and arranged to selectively mate and unmate and the second closure is constructed and arranged to selectively mate, and once mated, cannot be unmated.

In another aspect, a flexible package is disclosed that includes a surrounding wall that defines a bottom, an interior volume, and a mouth to provide access to the interior volume. The flexible package also includes a closure assembly oriented at the mouth. The closure assembly includes a zipper closure arrangement having first and second zipper profiles constructed and arranged to selectively interlock and that define first and second closures. A slider device is oriented to slide laterally along the zipper closure arrangement and is oriented to be axially moveable from a first axial position to a second axial position. The first closure is constructed and arranged to mate when the slider device is in the first axial position and is moved laterally along the zipper closure arrangement in a first direction. The second closure is constructed and arranged to mate when the slider device is in the second axial position and is moved laterally along the zipper closure arrangement in the first direction, and when the slider device is in the first axial position, the second closure is constructed and arranged not to mate.

In yet another aspect, a method of using a package is disclosed. The package includes a package surrounding wall defining an interior volume, a mouth, and a closure assembly oriented at the mouth. The closure assembly includes a zipper closure arrangement and a slider device operably oriented on the zipper closure arrangement. The method of using the package includes grasping a slider device and pushing the slider device axially relative to the zipper closure arrangement to engage the slider device against the zipper closure arrangement, where the zipper closure arrangement includes a first closure and a second closure. The method further includes moving the slider device laterally in a first direction to close the first closure and to permanently close the second closure.

In a further aspect, a closure assembly for use with a flexible package is disclosed. The closure assembly includes a zipper closure arrangement having first and second zipper profiles constructed and arranged to selectively interlock into first and second mated positions. The first mated position includes the first and second zipper profiles being interlocked and being capable of being selectively unmated. The second mated position includes the first and second zipper profiles being interlocked and not being capable of being unmated. A slider device is oriented to slide laterally along the zipper closure arrangement to move the zipper closure arrangement from the first mated position to the second mated position.

In another aspect, a flexible package is disclosed. The flexible package includes a surrounding wall defining a bottom, an interior volume, and a mouth to provide access to the interior volume. The flexible package also includes a closure assembly oriented at the mouth, where the closure assembly includes a zipper closure arrangement comprising first and second zipper profiles constructed and arranged to selectively interlock into first and second mated positions. The first mated position includes the first and second zipper profiles being interlocked and being capable of being selectively unmated. The second mated position includes the first and second zipper profiles being interlocked and not being capable of being unmated. A slider device is oriented to slide laterally along the zipper closure arrangement to move the zipper closure arrangement from the first mated position to the second mated position.

In yet another aspect, a method of using a package is disclosed. The package includes a package surrounding wall defining an interior volume, a mouth, and a closure assembly oriented at the mouth. The closure assembly includes a zipper closure arrangement and a slider device operably oriented on the zipper closure arrangement, and the zipper closure arrangement includes a first mated position and a second mated position. The method of using the package includes grasping the slider device and moving the slider device laterally in a first direction to move the zipper closure arrangement from the first mated position to the second mated position.

The above summary of the present invention is not intended to describe each illustrated embodiment or every implementation of the present invention. The figures and detailed description that follow more particularly exemplify these embodiments.

DETAILED DESCRIPTION

The present invention is believed to be applicable to a variety of packaging arrangements. The invention has been found to be particularly advantageous for use in sealing mechanisms for polymeric packages. An appreciation of various aspects of the invention is best gained through a discussion of application examples for such a packaging arrangement.

Example 1

Figure 1:
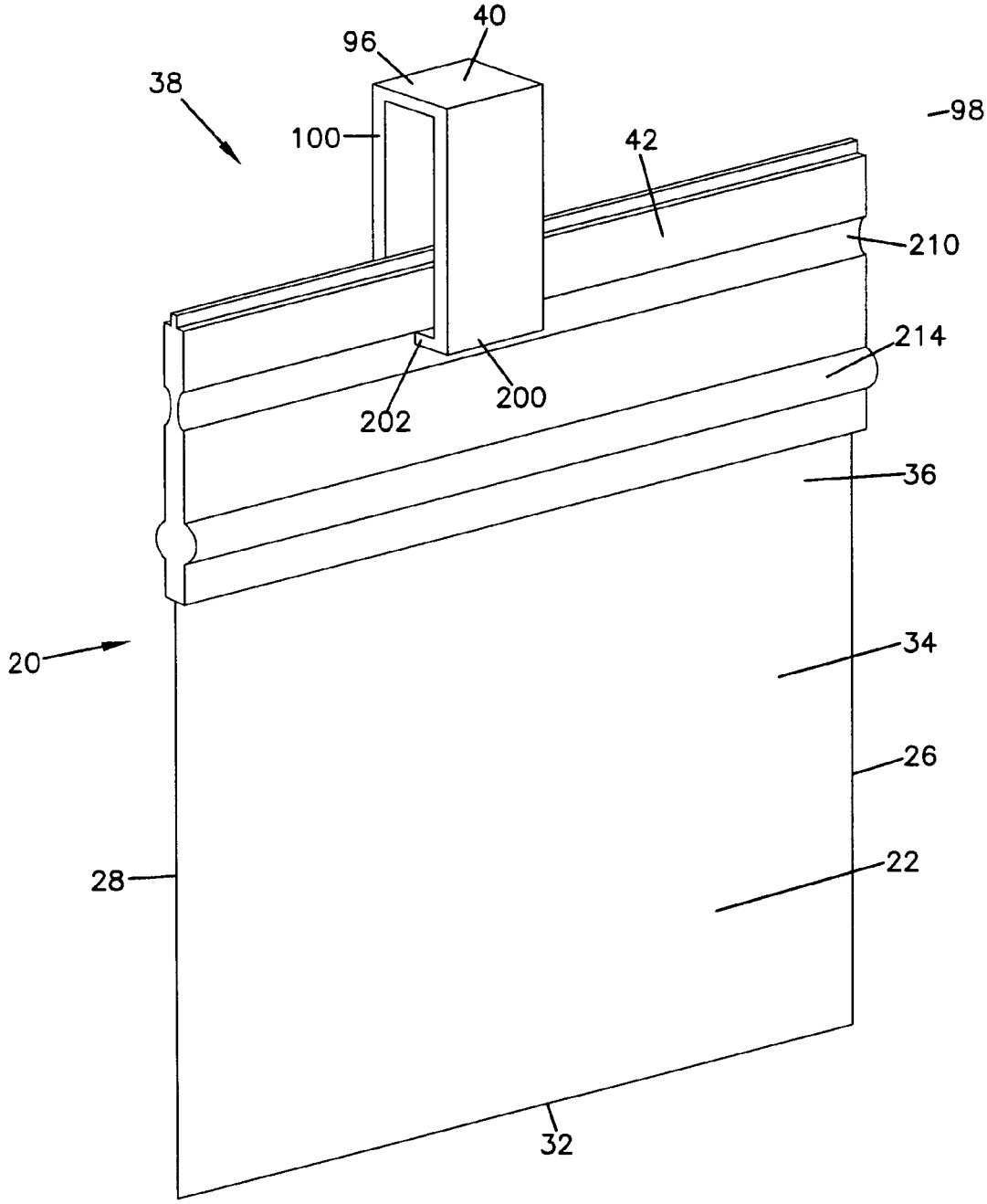
FIG. 1 is a perspective view of a package having a closure assembly including a zipper closure arrangement and a slider device.

FIG. 1 illustrates a package 20, which includes a first panel section 22 and second, opposed, panel section 24 (FIG. 2), typically made from a flexible polymeric film. For some manufacturing applications, the first and second panel sections 22, 24 are heat-sealed together along two edges 26, 28 and meet at a fold line in order to form a three-edged containment section for a product within the interior 30 (FIG. 2) of the package 20. The fold line comprises the bottom edge 32. Alternatively, two separate panel sections 22, 24 of polymeric film may be used and heat-sealed together along the two edges 26, 28 and at the bottom 32. Together, panel sections 22, 24 comprise a surrounding wall 34 that defines the package interior 30. Access is provided to the interior 30 of the package 20 through a mouth 36. A closure assembly 38 is part of package 20 adjacent to mouth 36.

Figure 2:
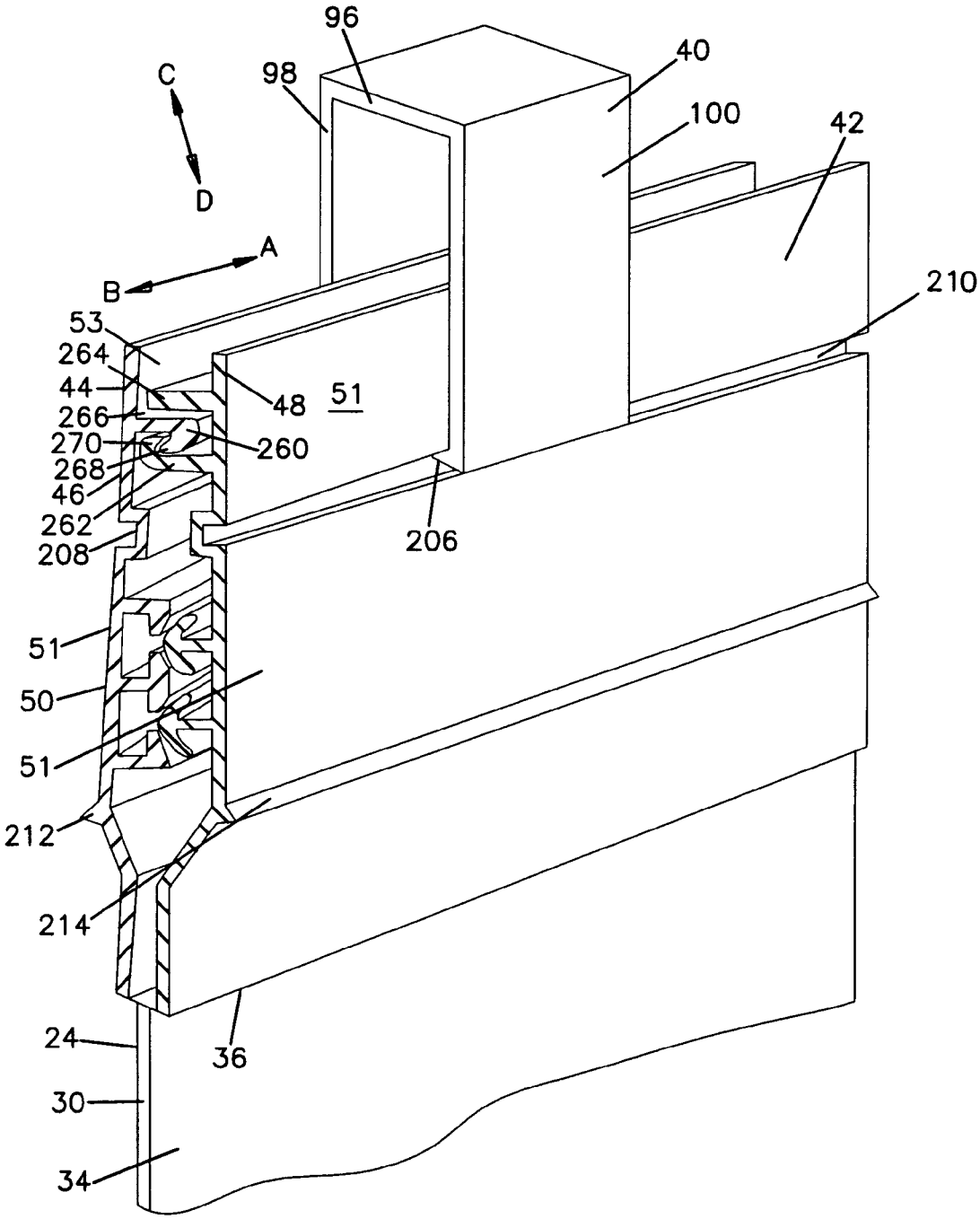
FIG. 2 is a perspective view of the closure assembly depicted in FIG. 1.

FIG. 2 illustrates an example closure assembly 38 constructed in accordance with the present disclosure. Closure assembly 38 comprises a slider device 40 and a zipper closure arrangement 42. Closure assembly 38 is shown in FIG. 1 attached to surrounding wall 34 along mouth 36. For example, closure assembly 38 may be heat sealed to surrounding wall 34. Other methods of attachment are possible.

Zipper closure arrangement 42 includes a first zipper profile 44 and a second zipper profile 48, which define a first closure 46 and a second closure 50. First and second zipper profiles 44, 48 further define exterior surfaces 51 and interior surfaces 53. First closure 46 and second closure 50 are constructed and arranged to selectively interlock. Many embodiments of first closure 46 and second closure 50 are useable. One usable embodiment of first closure 46 is a reclosable closure depicted in FIG. 2. A reclosable closure is one that can be repeatedly mated and unmated, when selected to do so by the zipper operator. In the embodiment shown in FIG. 2, first closure 46 includes a first hooked profile member 260 on the first zipper profile 44, and second hooked profile member 262 on the second zipper profile 48. Specifically, in the particular embodiment shown, the first and second hooked profile members 260, 262 have a J-shaped cross section. In the embodiment depicted in FIG. 2, the first closure 46 further includes a first closure post 264 on the second zipper profile 48 adjacent to the first hooked profile member 260. A gap 266 is formed between the first closure post 264 and the second hooked profile member 262 that is configured and arranged to receive the first hooked profile member 260 when the first and second hooked profile members 260, 262 are mated.

The first and second hooked profile members 260, 262 are constructed and arranged to selectively mate and separate. Specifically, an end region 268 of the first hooked profile member 260 engages with an opposing end region 270 of the second hooked profile member 262 to interlock the first and second hooked profile members 260, 262. To separate the first and second profile members 260, 262, sufficient force must be applied to closure 46 in a separating direction to cause first hooked profile member 260 and second hooked profile member 262 to deform and to slide out of contact. In some embodiments, a slider device is used to separate the members 260, 262, as described further below.

Second closure 50 is also constructed and arranged to selectively interlock. Many embodiments of closure 50 are useable. In one usable embodiment, closure 50 is proximate to first reclosable closure 46 along first and second zipper profiles 44, 48. In one usable embodiment, closure 50 is a closure constructed in accordance with the embodiment depicted in FIG. 2. In the embodiment depicted in FIG. 2, second closure 50 cannot be unmated after being mated.

Figure 3:
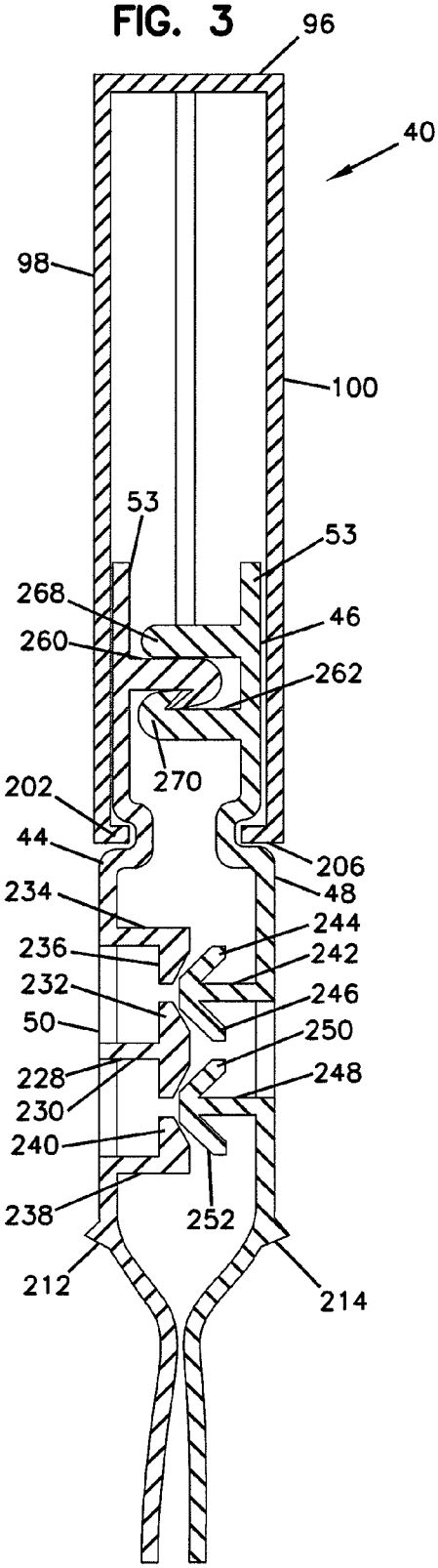
FIG. 3 is a cross-sectional view of the zipper closure arrangement depicted in FIG. 1 with the slider device in a first axial position.
Figure 4:
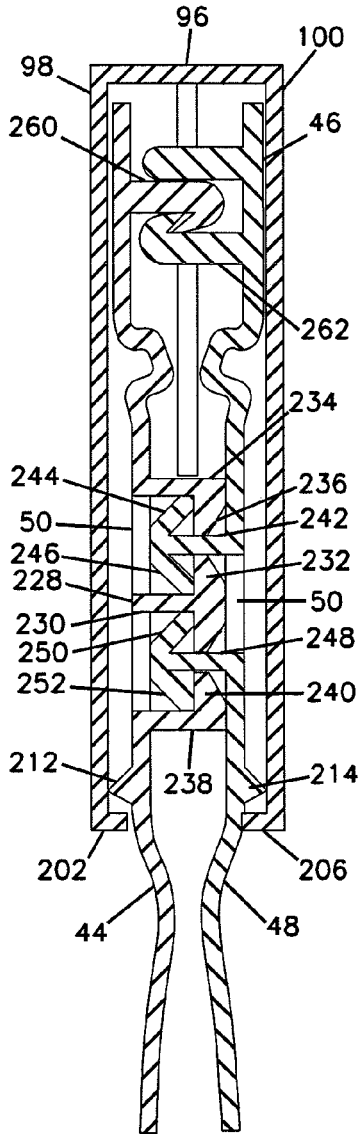
FIG. 4 is a cross-sectional view of the zipper closure arrangement depicted in FIG. 1 with the slider device in a second axial position.

In reference now to FIGS. 2 and 3, second closure 50 includes the first zipper profile 44 and the second zipper profile 48. First zipper profile 44 includes a first closure member 228 having a neck 230 terminating with a head 232 wider than the neck 230, a first arm 234 terminating with a finger 236, and a second arm 238 terminating with a finger 240. The first closure member 228 is spaced from and between the first arm 234 and second arm 238. Second zipper profile 48 includes a first leg 242 terminating with a pair of hooks 244, 246, and a second leg 248 spaced from the first leg 242 and terminating with a pair of hooks 250, 252. When the second closure 50 is in a mated position, as shown in FIG. 4, the second closure 50 includes: (i) the first leg 242 being between the first arm 234 and the first closure member 228; (ii) the first leg pair of hooks 244, 246 engaging the head 232 and the first arm finger 236, respectively; (iii) the second leg 248 being between the second arm 238 and the first closure member 228; and (iv) the second leg pair of hooks 250, 252 engaging the head 232 and the second arm finger 240, respectively.

Figure 5:
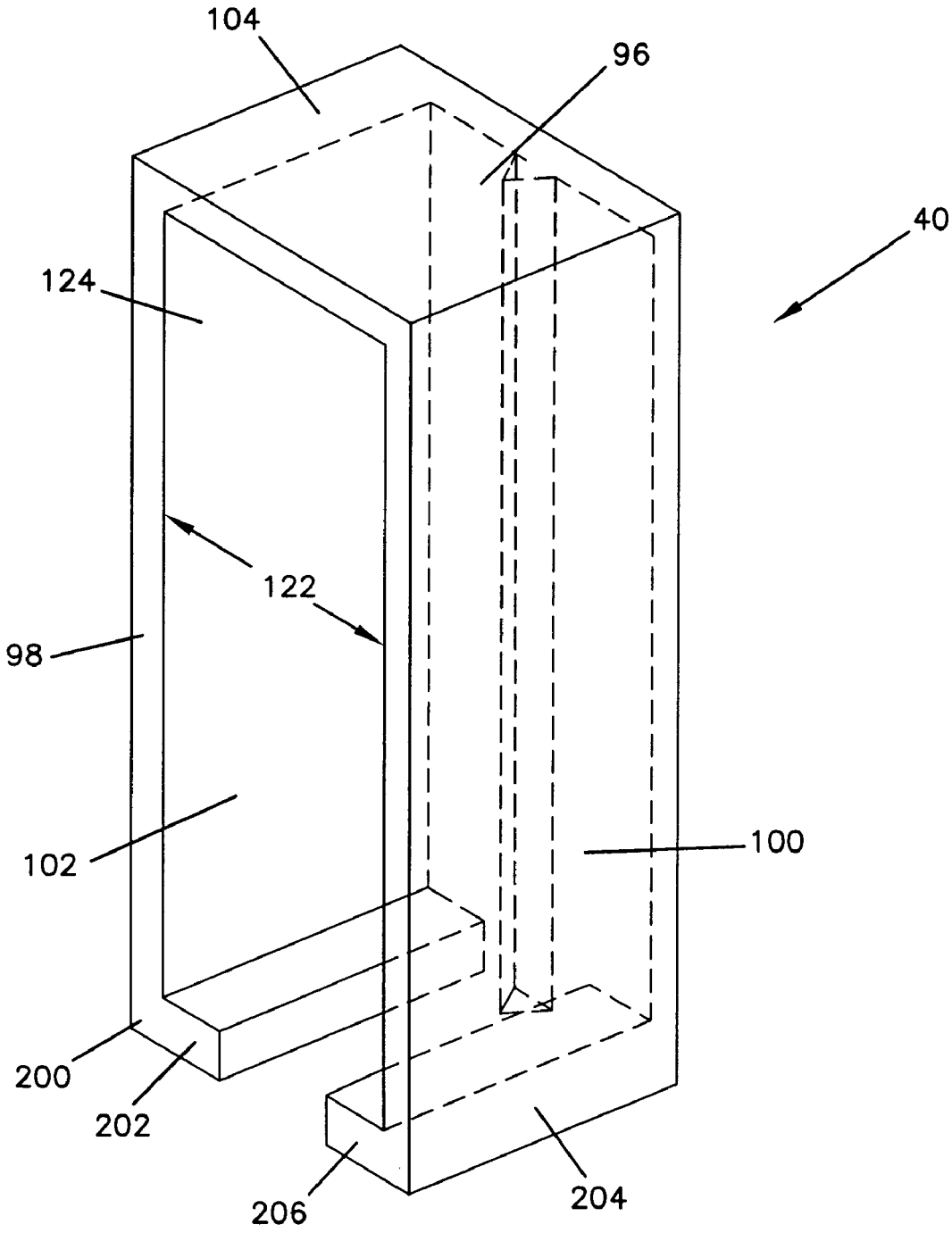
FIG. 5 is a perspective view of the slider device depicted in FIG. 1.

Closure assembly 38 includes a slider device 40. Slider device 40 is constructed to selectively squeeze one or more of first and second closures 46, 50 through exterior surface 51. Slider device 40 is oriented to slide laterally along the zipper closure arrangement 42, as indicated by directions A and B in FIG. 2. In the embodiment shown in FIG. 2, slider device 40 is also oriented to be axially movable, as indicated by directions C and D in FIG. 2, from a first axial position to a second axial position. Many embodiments of slider device 40 are usable. A perspective view of one useable embodiment of a slider device 40 is shown in FIG. 5. In the embodiment depicted in FIG. 5, slider device 40 comprises a top wall 96, a first side wall 98 depending from top wall 96, and a second side wall 100 depending from top wall 96. Top wall 96 comprises an exterior surface 104 and an interior surface 106. Interior surface 106 is apparent in FIG. 6. In the embodiment of slider 40 depicted in FIG. 5, first sidewall 98 of slider device 40 defines an end 200 with a foot 202, and second sidewall 100 defines an end 204 with a foot 206.

Together, the top wall 96, first side wall 98, and second side wall 100 define a cavity 102 to operatively receive a zipper closure arrangement 42. First and second sidewalls 98, 100 of slider device 40 define a first width 122 therebetween to define zipper squeezing surfaces 124. The first width 122 is sized to cause the first and second sidewalls 98, 100 to squeeze at least a portion of the zipper closure arrangement 42.

Slider device 40 is axially movable between a first axial position and a second axial position. In the embodiment depicted in FIG. 2, zipper closure arrangement 42 defines a first external groove 208 in the first zipper profile 44 and a second external groove 210 in the second zipper profile 48. First and second external grooves 208, 210 are located between first closure 46 and second closure 50. When slider device 40 is in the first axial position, as shown in FIGS. 2 and 3, the first sidewall foot 202 is seated in the first groove 208 and the second sidewall foot 206 is seated in the second groove 210, and zipper squeezing surfaces 124 are arranged to apply a squeezing force to first closure 46.

In the embodiment shown, zipper closure arrangement 42 also includes a first externally directed projection 212 in the first zipper profile 44 and a second externally directed projection 214 in the second zipper profile 48 (FIGS. 2-4). The second closure 50 is located between the first and second externally directed projections 212, 214 and the first closure 46. When slider device 40 is in the second axial position, as shown in FIG. 4, first projection 212 is between first sidewall foot 202 and the second closure 50, and second projection 214 is between second sidewall foot 206 and the second closure 50.

Figure 6:
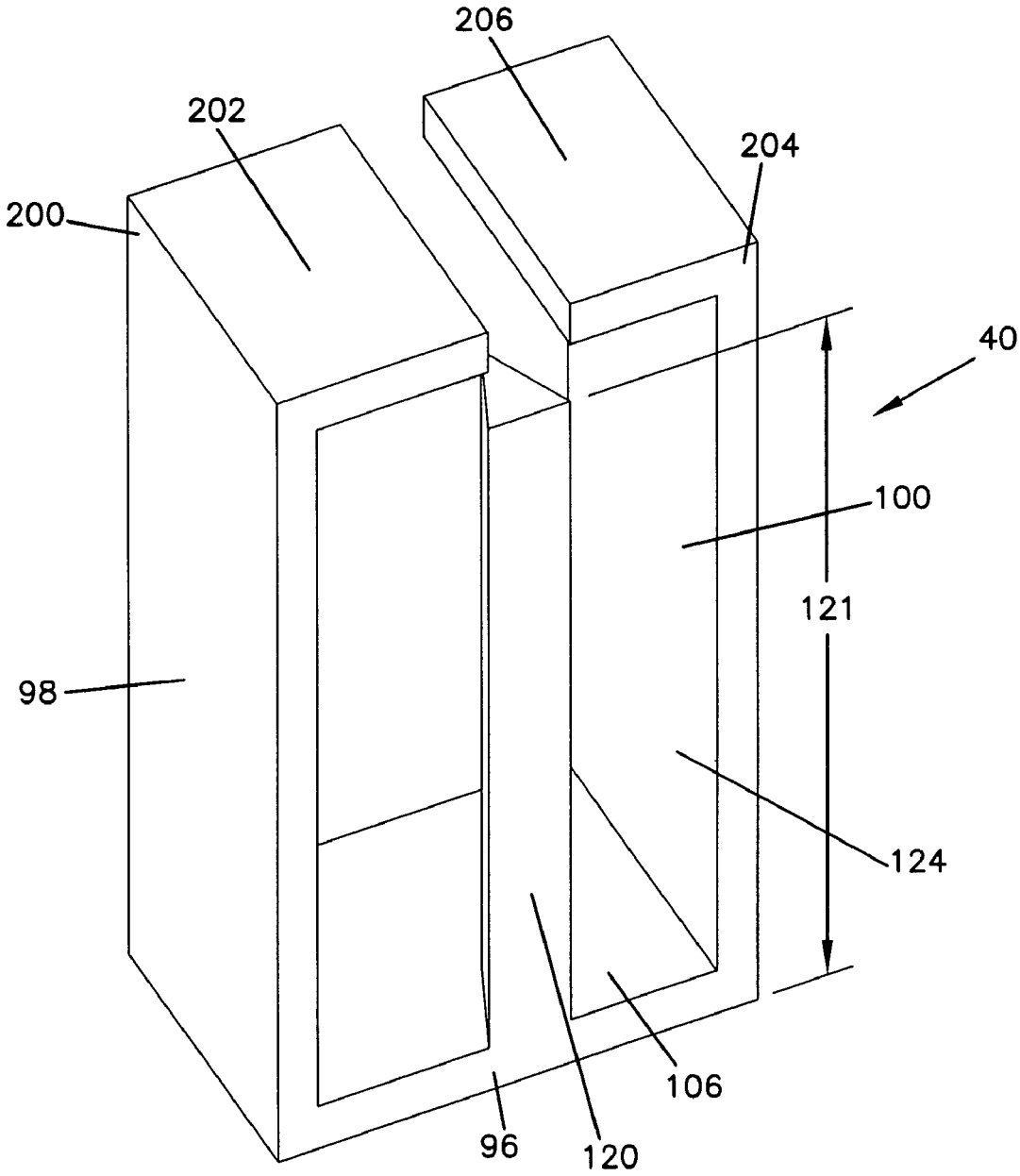
FIG. 6 is an alternative perspective view of the slider device depicted in FIG. 1.

In some embodiments, slider device 40 includes a plow or splitter 120. Splitter 120 is constructed and arranged to at least partially separate the zipper closure arrangement 42 when the slider device 40 is slid along the zipper closure arrangement 42, such as in direction B indicated in FIG. 2. One embodiment of a splitter 120 is depicted in FIG. 6. The depicted splitter 120 depends from interior surface 106 of top wall 96, and is generally wedge-shaped. Splitter 120 is characterized by a splitter depth 121, defined as the distance that splitter 120 protrudes away from interior surface 106. Splitter depth 121 is sized so that splitter 120 contacts interior surfaces 53 of first and second zipper profiles 44, 48, but does not contact first or second closures 46, 50, when splitter 40 is in the first axial position. The splitter 120 is constructed and arranged to separate the first closure 46 when the slider device 40 is moved laterally along the zipper closure arrangement 42 in a second direction opposite of the first direction, such as in direction B in FIG. 10 by applying force in a separating direction to interior surfaces 53. If second closure 50 is closed, first and second zipper profiles 44, 48 have insufficient stiffness to cause the separating force applied to interior surfaces 53 to separate second closure 50 when slider device 40 is moved along zipper closure arrangement 42 in the second direction.

In use, when slider device 40 is in the first axial position, zipper squeezing surfaces 124 (FIG. 5) of slider 40 engage with and are slidably disposed along exterior surfaces 51 (FIG. 2) of zipper closure arrangement 42, proximate to first closure 46. When slider device 40 is slid laterally along zipper closure arrangement 42, as in direction A shown in FIG. 2, zipper squeezing surfaces 124 generally contact zipper closure arrangement 42 along exterior surface 51 and apply a compression load or squeezing force to first closure 46, causing first and second hooked profile members 260, 262 to become mated.

A user may unmate first closure 46 from the first mated position by grasping slider 40 while in the first axial position and sliding it laterally along zipper closure arrangement 42 in direction B. Splitter 120 applies a separating force to first and second zipper profiles 46, 50 that is sufficient to unmate first closure 46. Alternatively, a user may unmate first closure 46 by grasping closure assembly 38 and manually applying sufficient force in a separating direction.

When slider device 40 is placed in the second axial position and moved axially in direction D (FIG. 2) relative to the zipper closure arrangement 42, as shown in FIG. 4, zipper squeezing surfaces 124 of slider 40 engage with and are slidably disposed along exterior surfaces 51 of zipper closure arrangement 42 proximate to both first closure 46 and second closure 50. When slider device 40 is then slid laterally along zipper closure arrangement 42, as in direction A shown in FIG. 2, zipper squeezing surfaces 124 generally contact zipper closure arrangement 42 and apply a compression load or squeezing force to first closure 46 and second closure 50, causing first closure 46 to be mated such that first and second hooked profile members 260, 262 are mated, and causing second closure 50 to be mated. When the second closure 50 is mated, in the embodiment shown: (i) first leg 242 is between the first arm 234 and the first closure member 228; (ii) the first leg 242 pair of hooks 244, 246 engage the head 232 and the first arm finger 236, respectively; (iii) the second leg 248 is between the second arm 238 and the first closure member 228; and (iv) the second leg 248 pair of hooks 250, 252 engage the head 232 and the second arm finger 240, respectively. After mating first and second closures 46, 50 in this manner, slider device 40 is configured to be removable from zipper closure arrangement 42 and can be disposed of. Once second closure arrangement 50 is mated, it cannot readily be unmated.

Example 2

Figure 7:
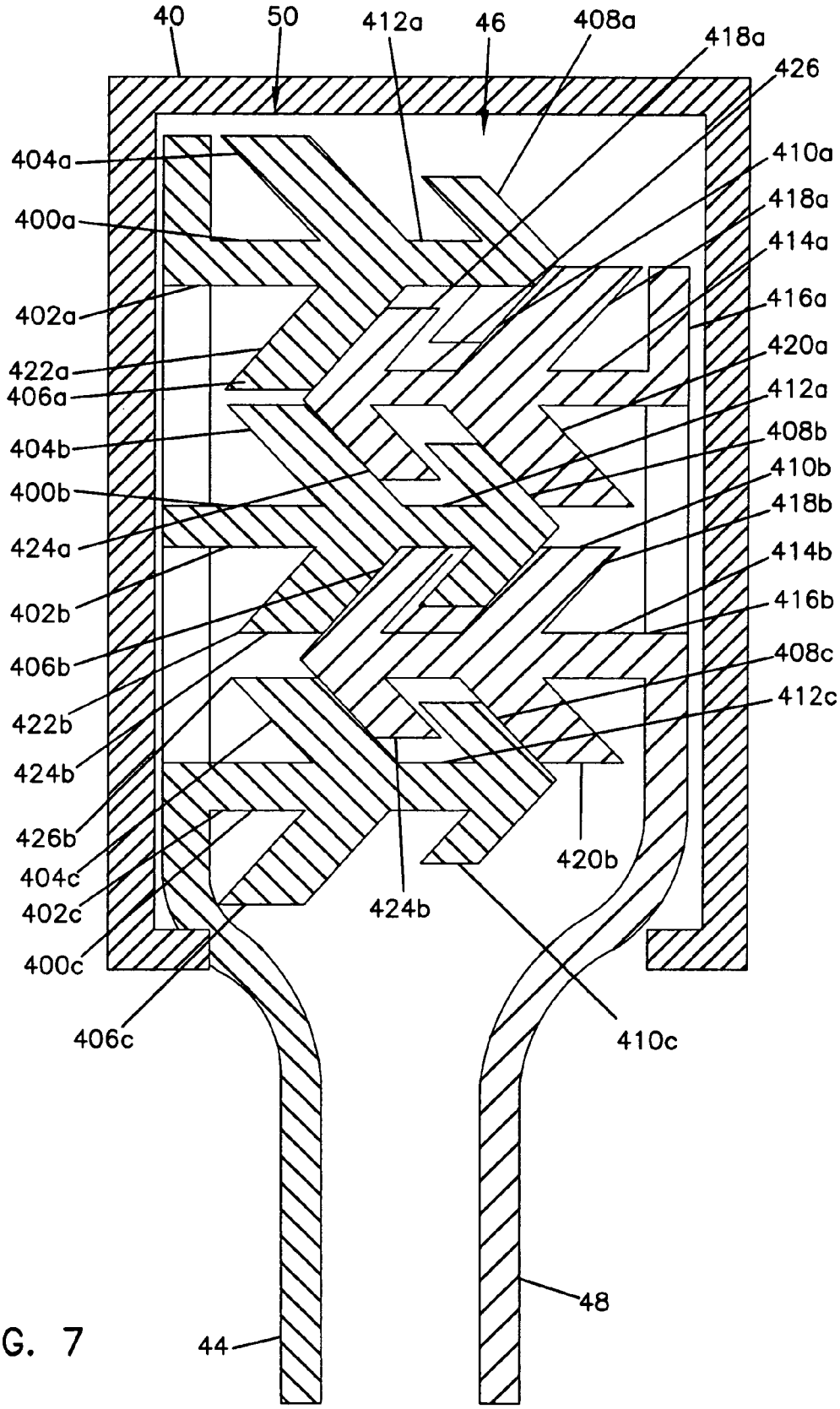
FIG. 7 is a cross-sectional view of an alternative embodiment of a zipper closure arrangement.
Figure 7A:
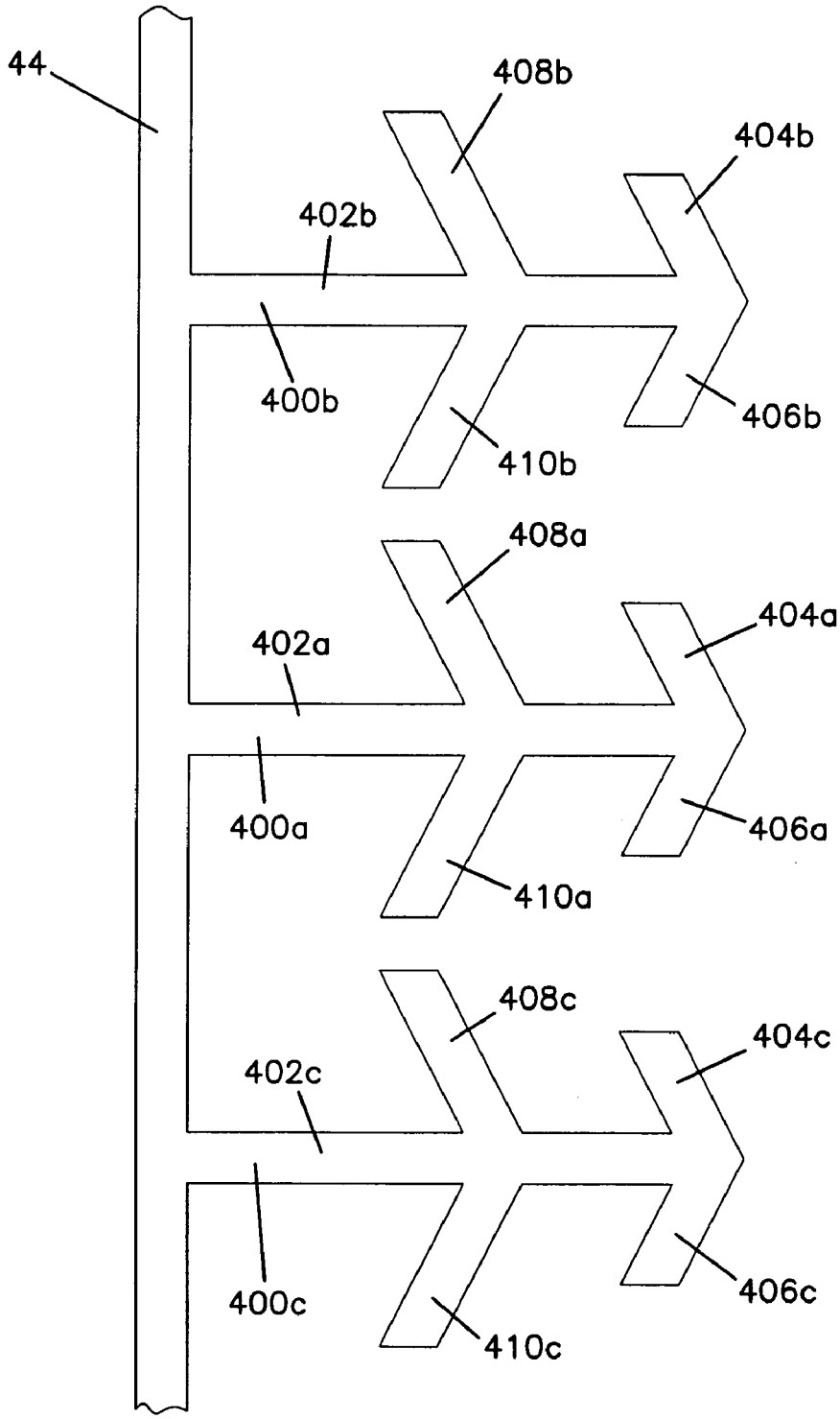
FIG. 7A is a cross-sectional view of a first zipper profile of the zipper closure arrangement depicted in FIG. 7.
Figure 7B:
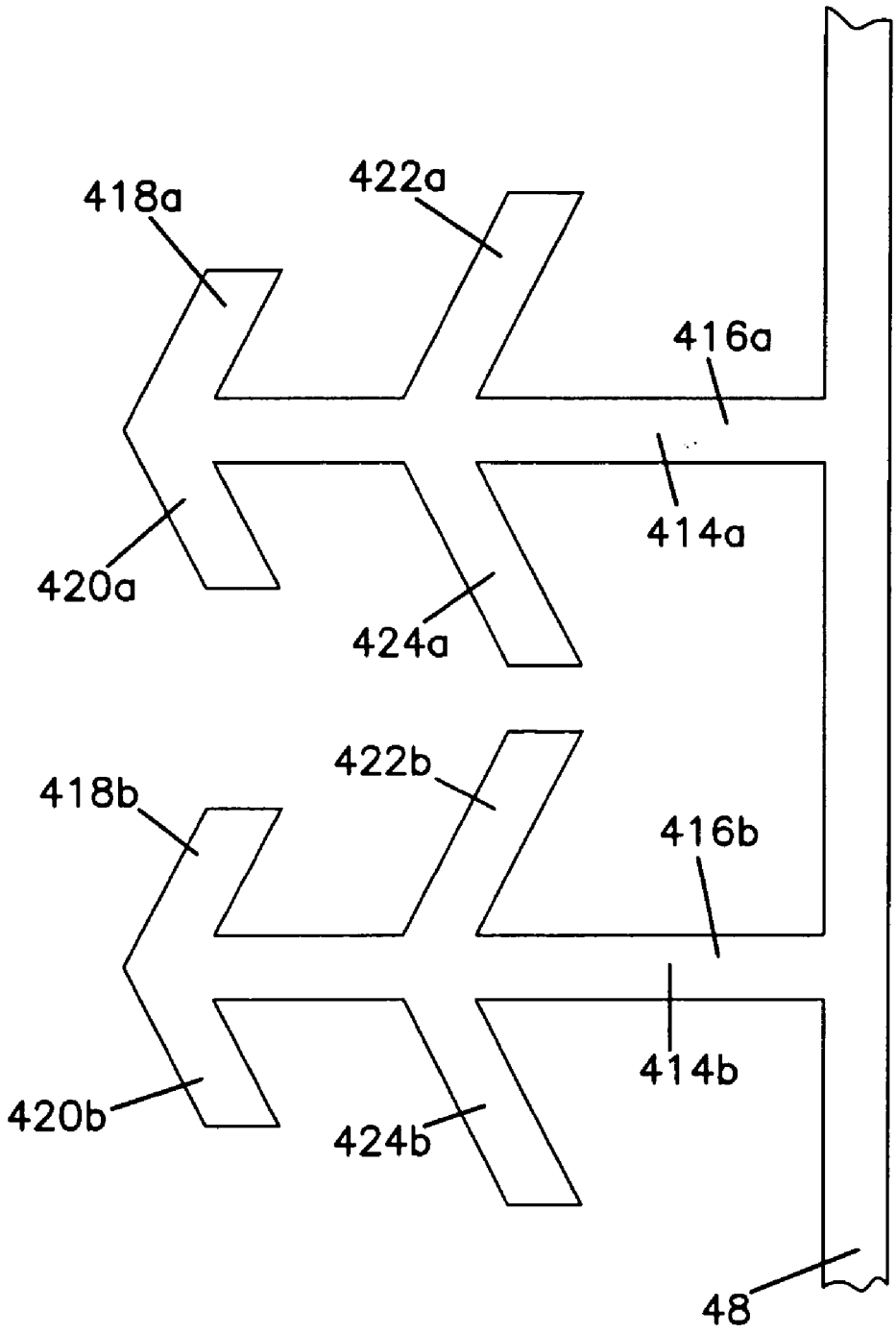
FIG. 7B is a cross-sectional view of a second zipper profile of the zipper closure arrangement depicted in FIG. 7.
Figure 8:
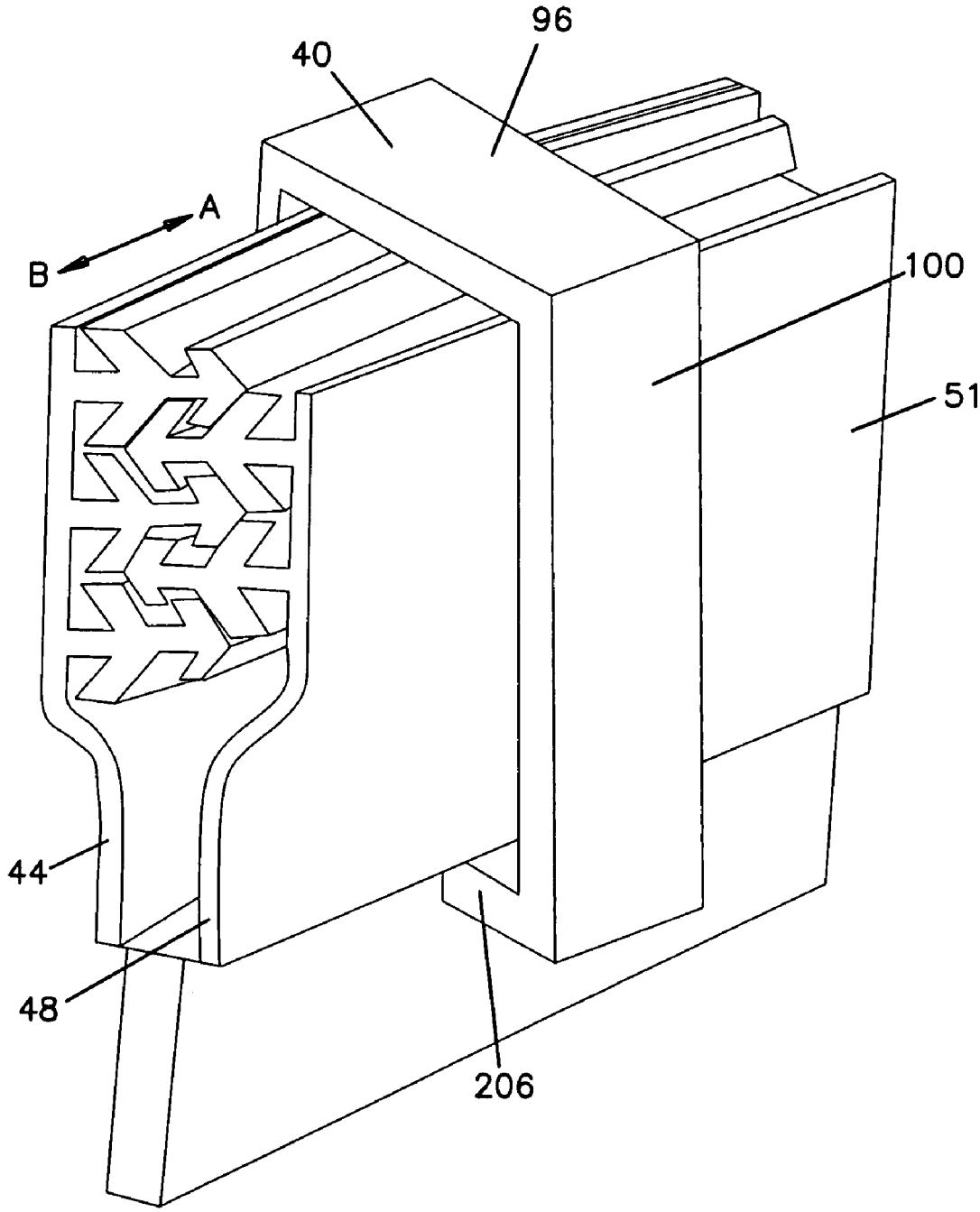
FIG. 8 is a perspective view of the closure assembly depicted in FIG. 7.

Many other embodiments of closure assembly 38 are usable. One usable embodiment is depicted in FIGS. 7 and 8. In the embodiment shown in FIGS. 7 and 8, zipper closure arrangement 42 includes the first zipper profile 44 and the second zipper profile 48, which define first closure 46 and second closure 50. First closure 46 and second closure 50 are constructed and arranged to selectively interlock. First closure 46 is defined by a first mated position of zipper closure arrangement 42, and second closure 50 is defined by a second mated position of zipper closure arrangement 42. The embodiment of closure 46 shown in FIG. 7 is a reclosable closure, meaning that closure 46 can be repeatedly mated and unmated, when selected to do so by the zipper operator. First and second zipper profiles 44, 48 include exterior surfaces 51. In the embodiment shown in FIGS. 7 and 7A, first zipper profile 44 includes a plurality of first closure members 400. Each first closure member 400 includes a leg 402 with a first pair of feet 404, 406 at an end of leg 402, and a second pair of feet 408, 410 on leg 402 spaced from the first pair of feet 404, 406. As shown in FIG. 7B, the second zipper profile 48 includes a plurality of second closure members 414. Each second closure member 414 includes an arm 416 with a first pair of fingers 418, 420 at an end of arm 416 and a second pair of fingers 422, 424 on arm 416 spaced from the first pair of fingers 418, 420. Generally, the second pair of feet 408, 410 and second pair of fingers 422, 424 are stiffer than the first pair of feet 404, 406 and first pair of fingers 418, 420.

In one embodiment, each of the first closure members first and second pairs of feet 404, 406 are arrow-shaped, and each of the second closure members first and second pairs of fingers 418, 420 are arrow-shaped. In some embodiments, each of first and second closure members 400, 414 comprise a material that includes a lubricant. For example, first and second closure members 400, 414 may comprise a material that includes a fat that migrates to the surface, or "blooms," between about 2 and 24 hours after production, to provide surface lubrication.

Figure 7C:
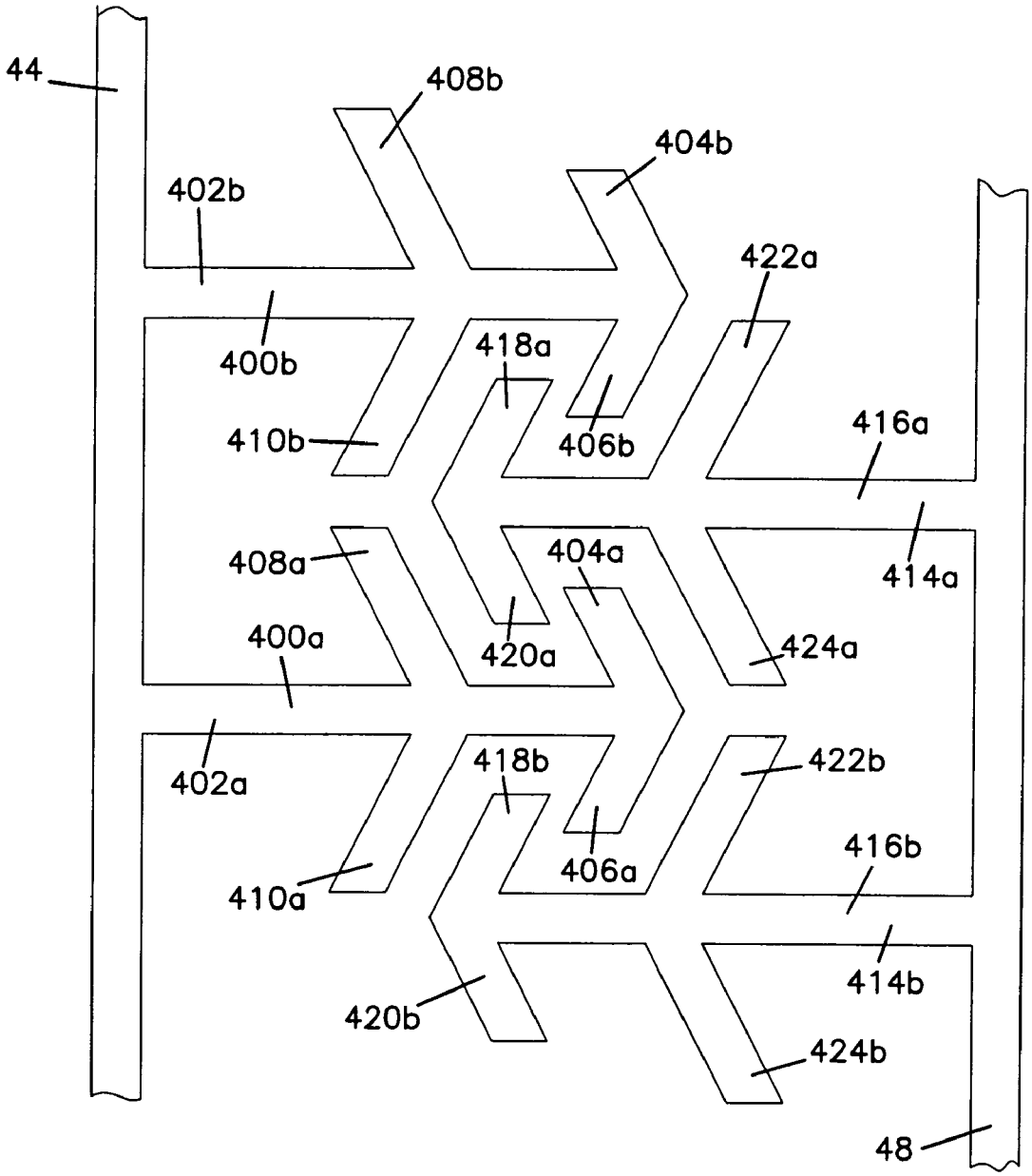
FIG. 7C is a cross-sectional view of an alternative embodiment of the zipper closure arrangement depicted in FIG. 7 in a first mated position.
Figure 7D:
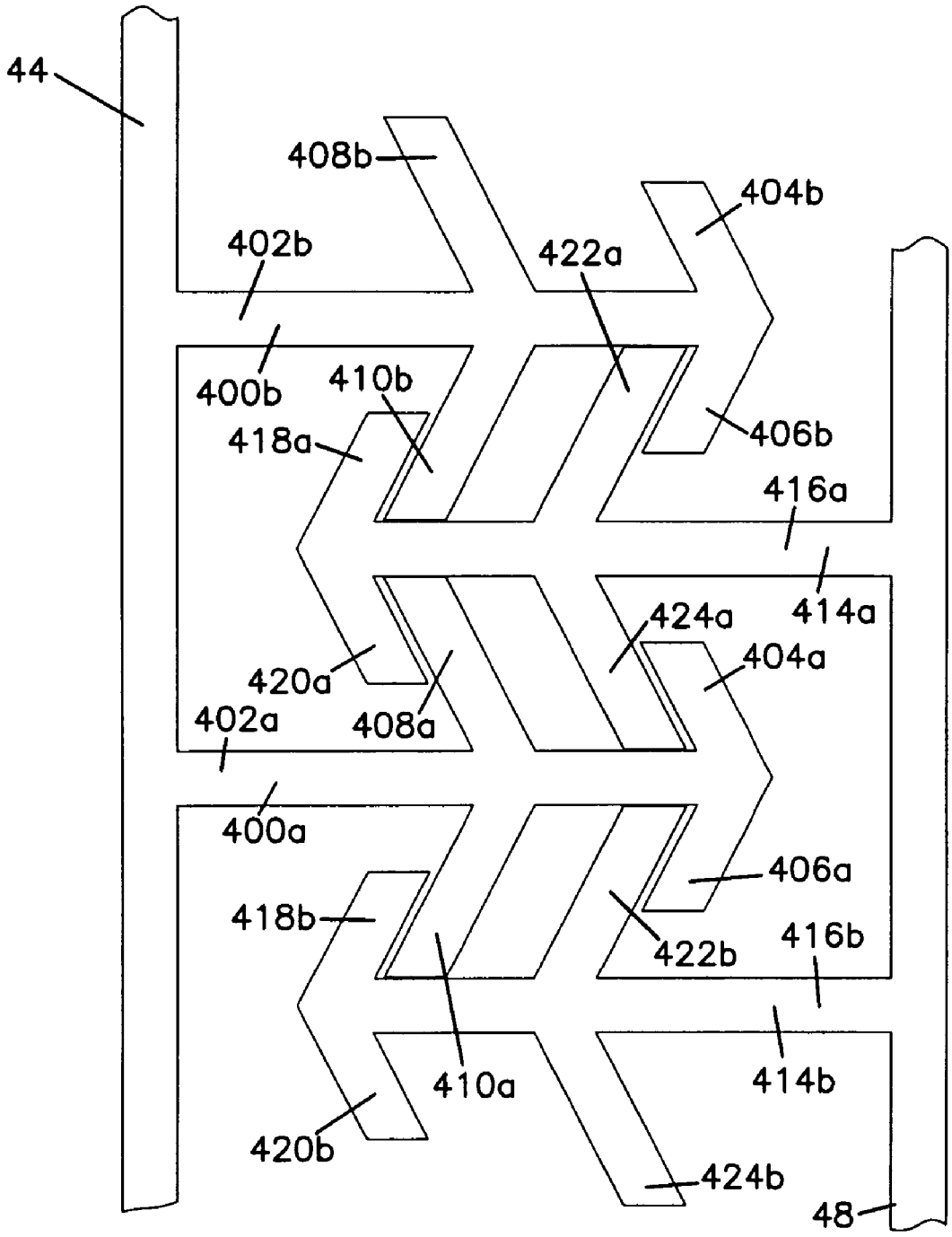
FIG. 7D is a cross-sectional view of an alternative embodiment of the zipper closure arrangement depicted in FIG. 7 in a second mated position.

In one embodiment of closure assembly 38 shown in FIGS. 7C and 7D, the plurality of first closure members 400 comprise at least a first leg 402*a*, further including feet 404*a*, 406*a*, 408*a*, and 410*a*, and a second leg 402*b*, further including feet 404*b*, 406*b*, 408*b*, and 410*b*. The plurality of second closure members 414 includes at least a first arm 416*a*, further including fingers 418*a*, 420*a*, 422*a*, and 424*a*, and a second arm 416*b*, further including fingers 418*b*, 420*b*, 422*b*, and 424*b*. In this embodiment, the first mated position (FIG. 7C) includes: (i) at least one of the first closure members 400, such as first leg 402*a* being oriented between first and second arms 416*a*, 416*b*; (ii) the second leg first foot 406*b* being between the first arm first finger 418*a* and first arm second finger 422*a*; (iii) the first leg first foot 404*a* being between the first arm first finger 420*a* and the first arm second finger 424*a*; and (iv) the first leg second foot 406*a* being between the second arm first finger 418*b* and the second arm second finger 422*b*. In this embodiment, the second mated position (FIG. 7D) includes: (i) at least one of the first closure members 400, as first leg 402*a* being oriented between first and second arms 416*a*, 416*b*; (ii) the second leg second foot 410*b* being between the first arm first finger 418*a* and first arm second finger 422*a*; (iii) the first leg second foot 408*a* being between the first arm first finger 420*a* and first arm second finger 424*a*; and (iv) the first leg second foot 410*a* being between the second arm first finger 418*b* and the second arm second finger 422*b*.

Figure 7E:
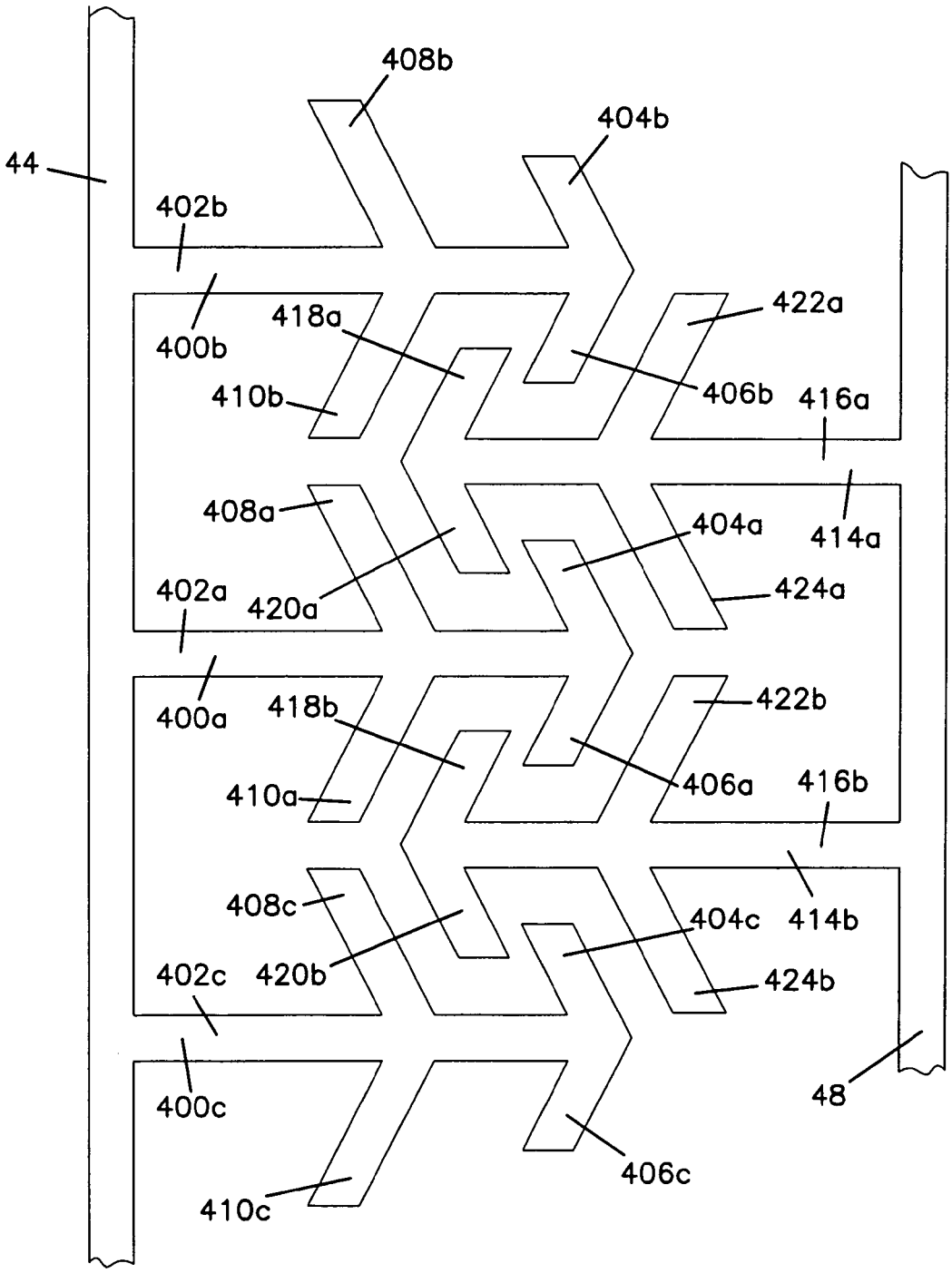
FIG. 7E is a cross-sectional view of the zipper closure arrangement depicted in FIG. 7 in a first mated position.
Figure 7F:
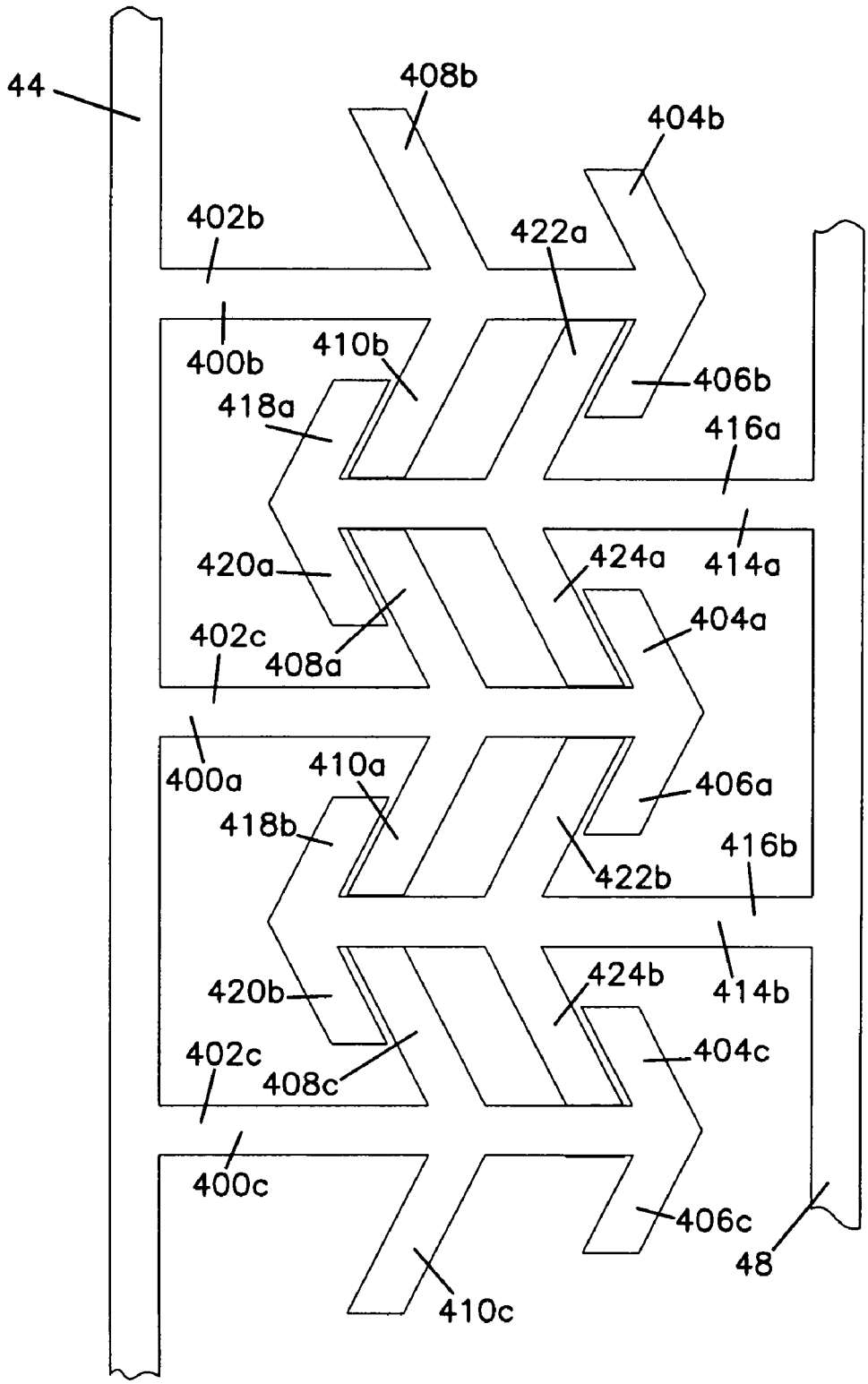
FIG. 7F is a cross-sectional view of the zipper closure arrangement depicted in FIG. 7 in a second mated position.

In another embodiment shown in FIGS. 7E and 7F, the plurality of first closure members further includes at least a third leg 402*c*, further including first feet 404*c*, 406*c*, and second feet 408*c*, 410*c*. In this embodiment, the first mated position (FIG. 7E) includes: (i) at least one of the first closure members 400, such as first leg 402*a* being oriented between first and second arms 416*a*, 416*b*; (ii) at least one of the second closure members 414, such as second arm 416*b* being oriented between first and third legs 402*a*, 402*c*; (iii) the second leg first foot 406*b* being between the first arm first finger 418*a* and first arm second finger 422*a*; (iv) the first leg first foot 404*a* being between the first arm first finger 420*a* and the first arm second finger 424*a*; (v) the first leg second foot 406*a* being between the second arm first finger 418*b* and the second arm second finger 422*b*; and (vi) the third leg first foot 404*c* being between the second arm first finger 420*b* and the second arm second finger 424*b*. In this embodiment, the second mated position (FIG. 7F) includes: (i) at least one of the first closure members 400, as first leg 402*a* being oriented between first and second arms 416*a*, 416*b*; (ii) at least one of the second closure members 414, such as second arm 416*b*, being oriented between the first and third legs 402*a*, 402*c*; (iii) the second leg second foot 410*b* being between the first arm first finger 418*a* and first arm second finger 422*a*; (iv) the first leg second foot 408*a* being between the first arm first finger 420*a* and first arm second finger 424*a*; (v) the first leg second foot 410*a* being between the second arm first finger 418*b* and the second arm second finger 422*b*; and (vi) the third leg second foot 408*c* being between the second arm first finger 420*b* and the second arm second finger 424*b*.

Figure 8A:
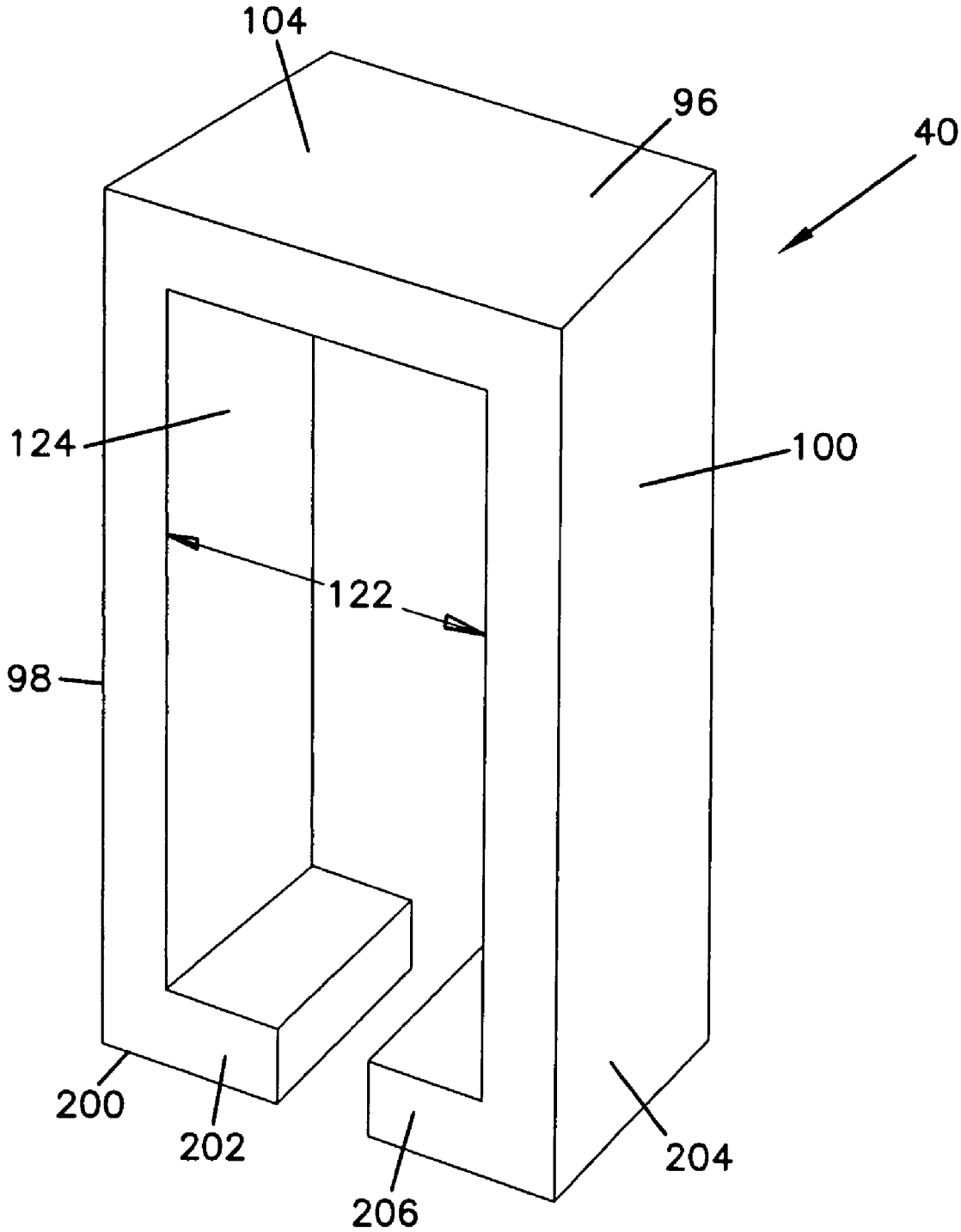
FIG. 8A is a perspective view of a slider device of the zipper closure arrangement depicted in FIG. 8.

Closure assembly 38 includes slider device 40. Slider device 40 is constructed to selectively squeeze one or more of first and second closures 46, 50 through exterior surfaces 51. Slider device 40 is oriented to slide laterally along the zipper closure arrangement 42, as indicated by directions A and B in FIG. 8. A perspective view of one useable embodiment of slider device 40 is shown in FIG. 8A. In the embodiment depicted in FIG. 8A, slider device 40 comprises a top wall 96, a first side wall 98 depending from top wall 96, and a second side wall 100 depending from top wall 96. Top wall 96 comprises an exterior surface 104 and an interior surface 106. In the embodiment of slider 40 depicted in FIG. 8A, first sidewall 98 of slider device 40 defines an end 200 with a foot 202, and second sidewall 100 defines an end 204 with a foot 206.

Together, the top wall 96, first side wall 98, and second side wall 100 define a cavity 102 to operatively receive a zipper closure arrangement 42. First and second sidewalls 98, 100 of slider device 40 define a first width 122 therebetween to define zipper squeezing surfaces 124. The first width 122 is sized to cause the first and second sidewalls 98, 100 to squeeze at least a portion of the zipper closure arrangement 42.

There are many usable embodiments for effecting the first mated position and second mated position. In the embodiment depicted in FIGS. 7 and 8, a user effects the first mated position by grasping closure assembly 38 and manually applying sufficient squeezing pressure to cause the zipper closure arrangement 42 to enter the first mated position, as shown in FIGS. 7C and 7E. To enter the first mated position, each of first foot 406*b* and first finger 418*a*, and first foot 404*a* and first finger 420*a*, and first foot 406*a* and first finger 418*b* must deform and slide past each other. Typically, because first pair of feet 404, 406 and first pair of fingers 418, 420 are less stiff than the second pair of feet 408, 410 and second pair of fingers 422, 424, a force that is sufficient to cause the zipper closure arrangement 42 to enter the first mated position will be insufficient to cause the zipper closure arrangement 42 to enter the second mated position.

A user may unmate first closure 46 by grasping closure assembly 38 and manually applying sufficient force in a separating direction.

The second mated position is effected by sliding slider 40 laterally along zipper closure arrangement 42. Zipper squeezing surface 124 of slider 40 applies squeezing force to exterior surface 51 of zipper closure arrangement 42 to cause zipper closure arrangement 42 to enter the second mated position. In the embodiment depicted in FIGS. 7E and 7F, entering the second mated position requires: (i) second foot 410*b* and first finger 418*a* must deform and slide past each other; (ii) first foot 406*b* and second finger 422*a* must deform and slide past each other; (iii) second foot 408*a* and first finger 420*a* must deform and slide past each other; (iv) first foot 404*a* and second finger 424*a* must deform and slide past each other; (v) first foot 406*a* and second finger 422*b* must deform and slide past each other; (vi) first foot 404*c* and second finger 424*b* must deform and slide past each other; (vii) second foot 410*b* and first finger 418*a* must deform and slide past each other; (viii) second foot 408*a* and first finger 420*a* must deform and slide past each other; (ix) second foot 410*a* and first finger 418*b* must deform and slide past each other; and (x) second foot 408*c* and first finger 420*b* must deform and slide past each other. Because second pairs of feet 408, 410, and second pairs of fingers 422, 424 are relatively stiff, once zipper closure arrangement 42 is in the second mated position, it cannot readily be unmated. In addition, once zipper closure arrangement 42 is in the second mated position, slider 40 may be removed from closure 38.

Example 3

Figure 9:
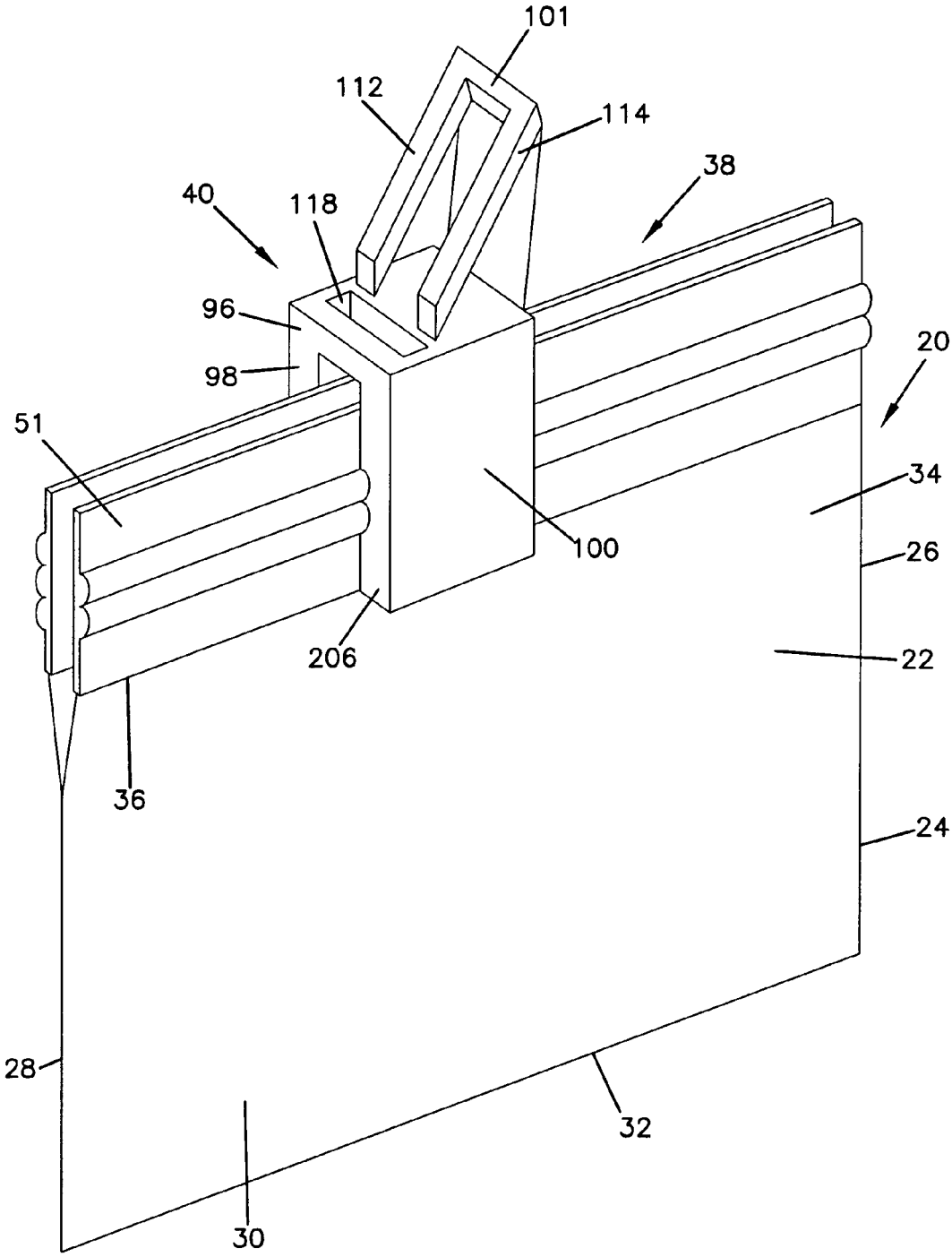
FIG. 9 is a perspective view of a package having an alternative embodiment of a closure assembly.
Figure 10:
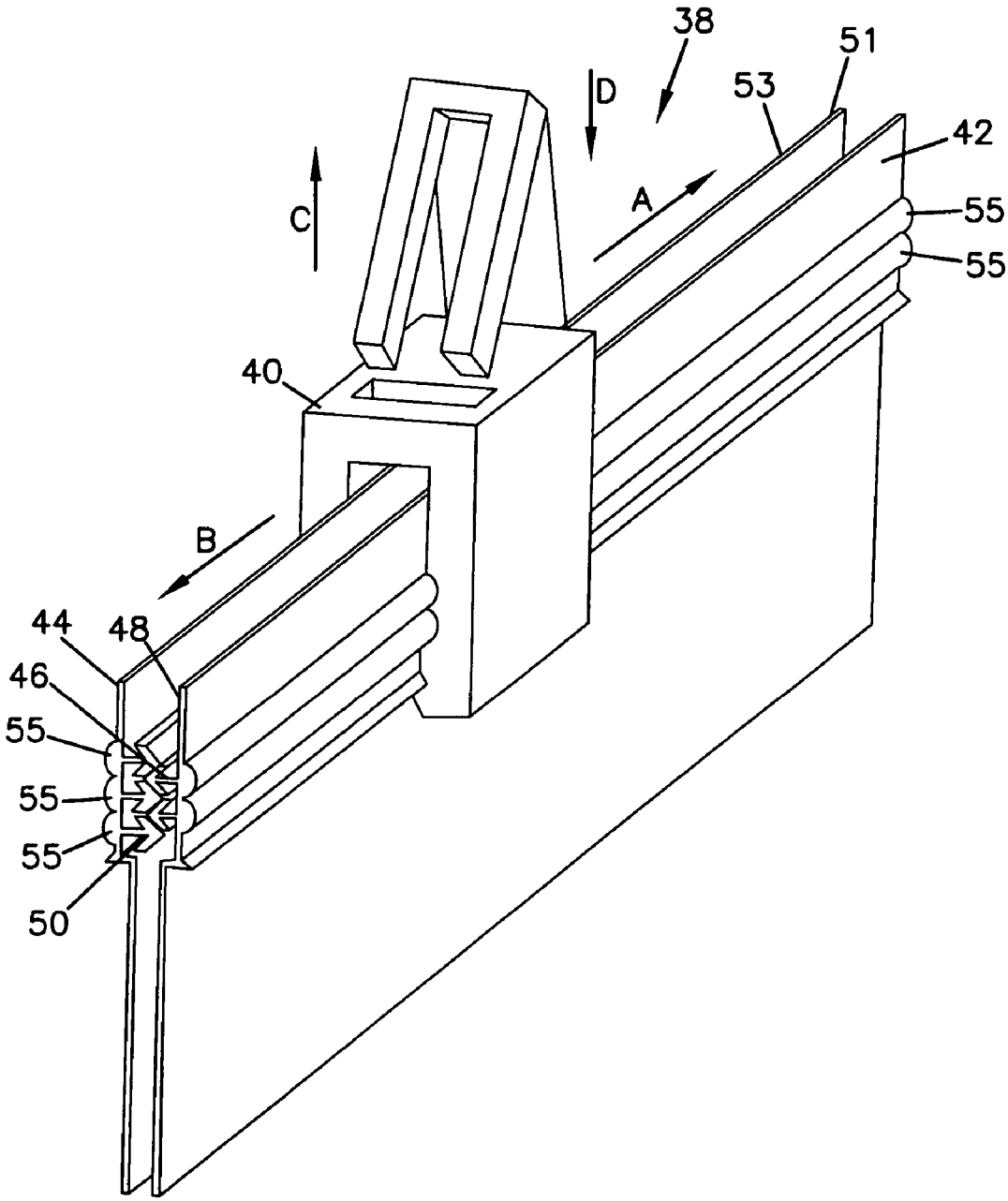
FIG. 10 is a perspective view of the closure assembly depicted in FIG. 9.
Figure 11:
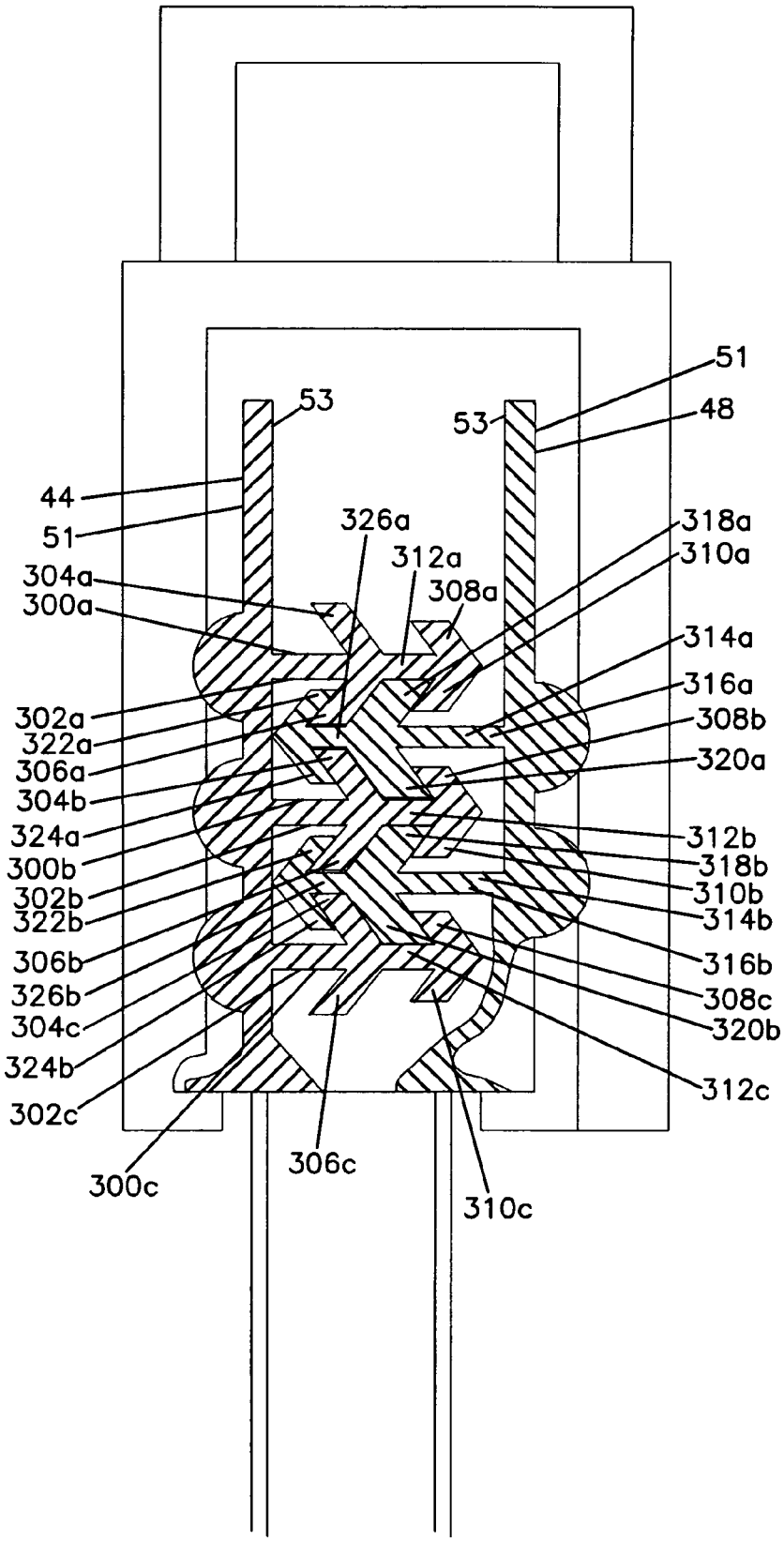
FIG. 11 is a cross-sectional view of the zipper closure arrangement depicted in FIG. 9.

Many other usable embodiments of closure 38 exist. One usable embodiment is depicted in FIGS. 9-11. In the embodiment shown in FIGS. 9-11, zipper closure arrangement 42 includes first zipper profile 44 and second zipper profile 48, which define first closure 46 and second closure 50. First closure 46 and second closure 50 are constructed and arranged to selectively interlock. First closure 46 is defined by a first mated position of zipper closure arrangement 42, and second closure 50 is defined by a second mated position of zipper closure arrangement 42. In one embodiment, first closure 46 is a reclosable closure and second closure 50 is a closure that cannot readily be unmated once it has been mated. A reclosable closure is one that can be repeatedly mated and unmated, when selected to do so by the zipper operator. First and second zipper profiles 44, 48 define exterior surfaces 51, interior surfaces 53, and a plurality of protrusions 55.

Figure 11A:
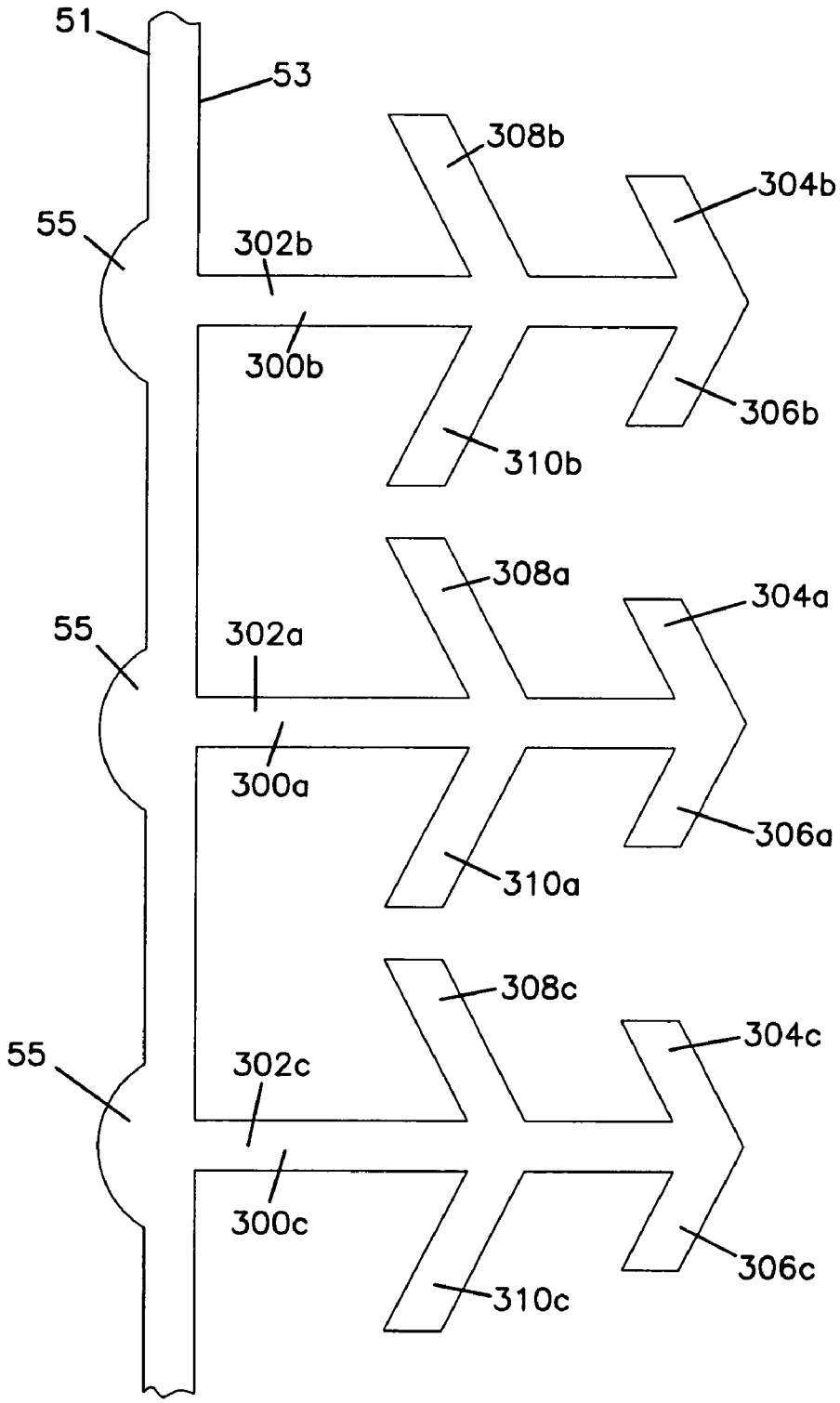
FIG. 11A is a cross-sectional view of a first zipper profile of the zipper closure arrangement depicted in FIG. 11.
Figure 11B:
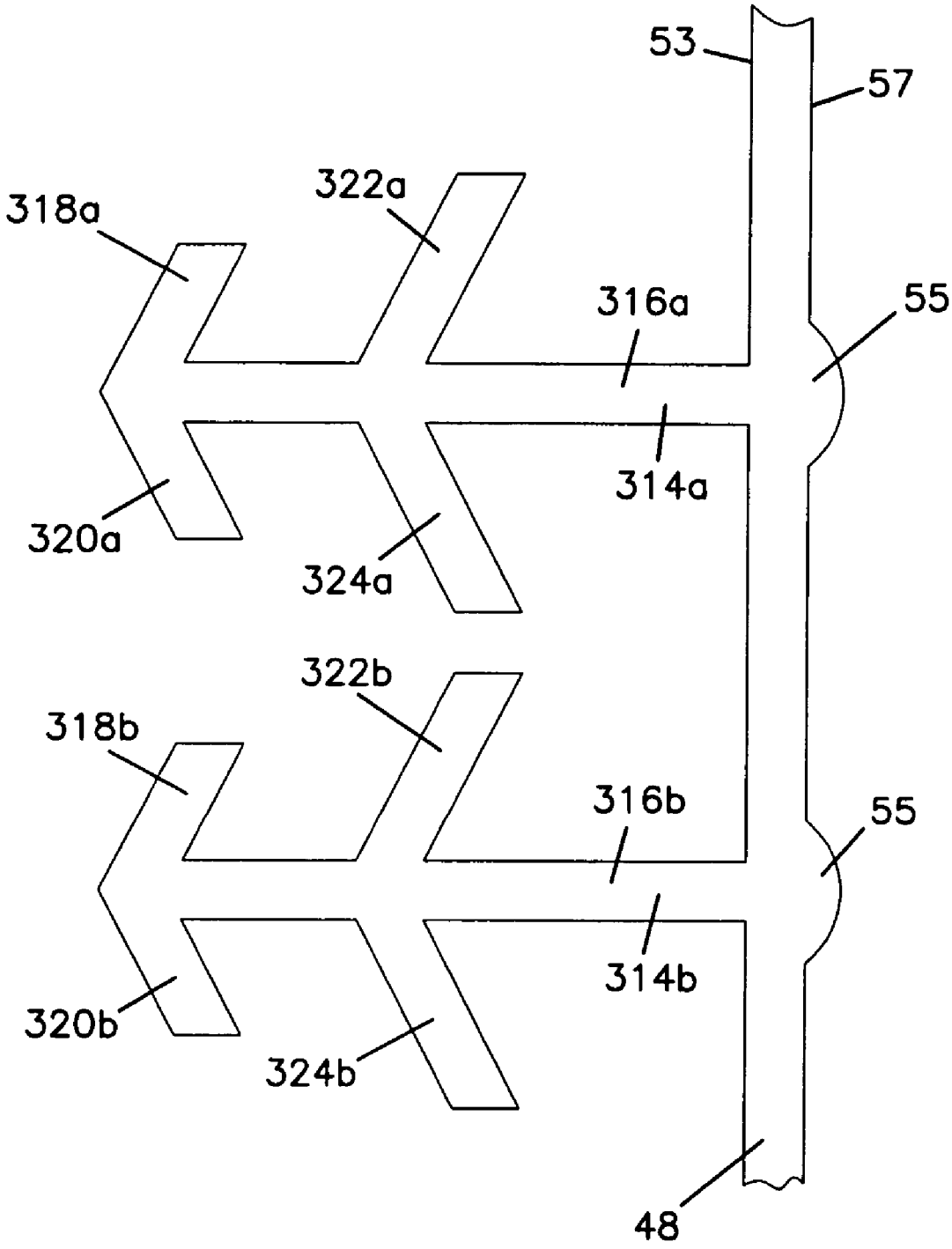
FIG. 11B is a cross-sectional view of a second zipper profile of the zipper closure arrangement depicted in FIG. 11.

In the embodiment shown in FIGS. 11 and 11A, first zipper profile 44 includes a plurality of first closure members 300. Each first closure member 300 includes a leg 302 with a first pair of feet 304, 306 at an end of leg 302, and a second pair of feet 308, 310 on leg 302 spaced from the first pair of feet 304, 306. Referring to FIG. 11B, the second zipper profile 48 includes a plurality of second closure members 314. Each second closure member 314 includes an arm 316 with a first pair of fingers 318, 320 at an end of arm 316 and a second pair of fingers 322, 324 on arm 316 spaced from the first pair of fingers 318, 320. Generally, the second pair of feet 308, 310 and second pair of fingers 322, 324 are stiffer than the first pair of feet 304, 306 and first pair of fingers 318, 320. Preferably, each protrusion 55 is positioned along exterior surface 51 opposite from each leg 302 or each arm 316 along interior surface 53.

In one embodiment, each of the first closure members first and second pairs of feet 304, 306 are arrow-shaped, and each of the second closure members first and second pairs of fingers 318, 320 are arrow-shaped. In some embodiments, each of first and second closure members 300, 314 comprise a material that includes a lubricant. For example, first and second closure members 300, 314 may comprise a material that includes a fat that migrates to the surface, or "blooms," between about 2 and 24 hours after production, to provide surface lubrication.

Figure 11C:
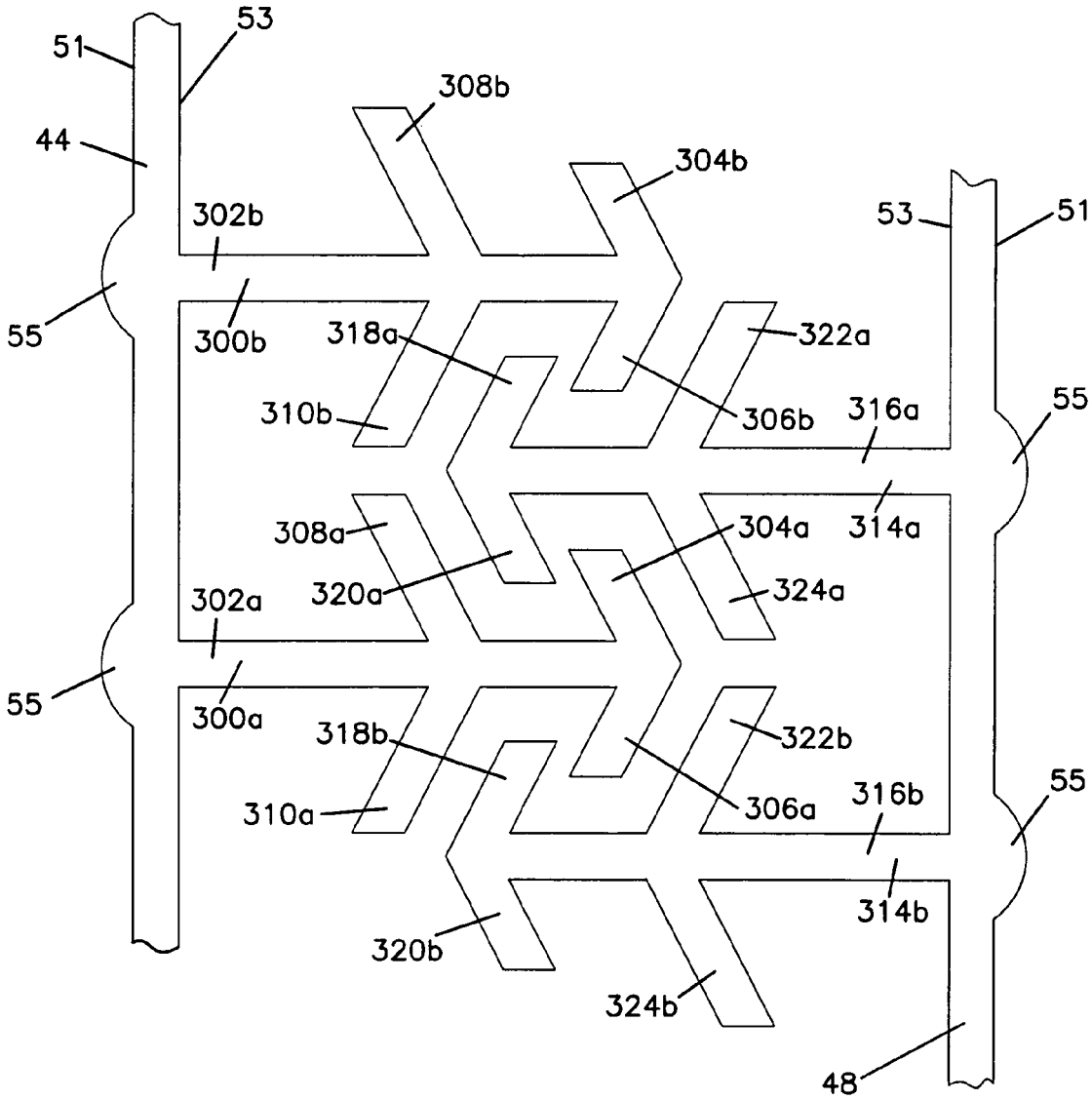
FIG. 11C is a cross-sectional view of an alternative embodiment of the zipper closure arrangement depicted in FIG. 11 in a first mated position.
Figure 11D:
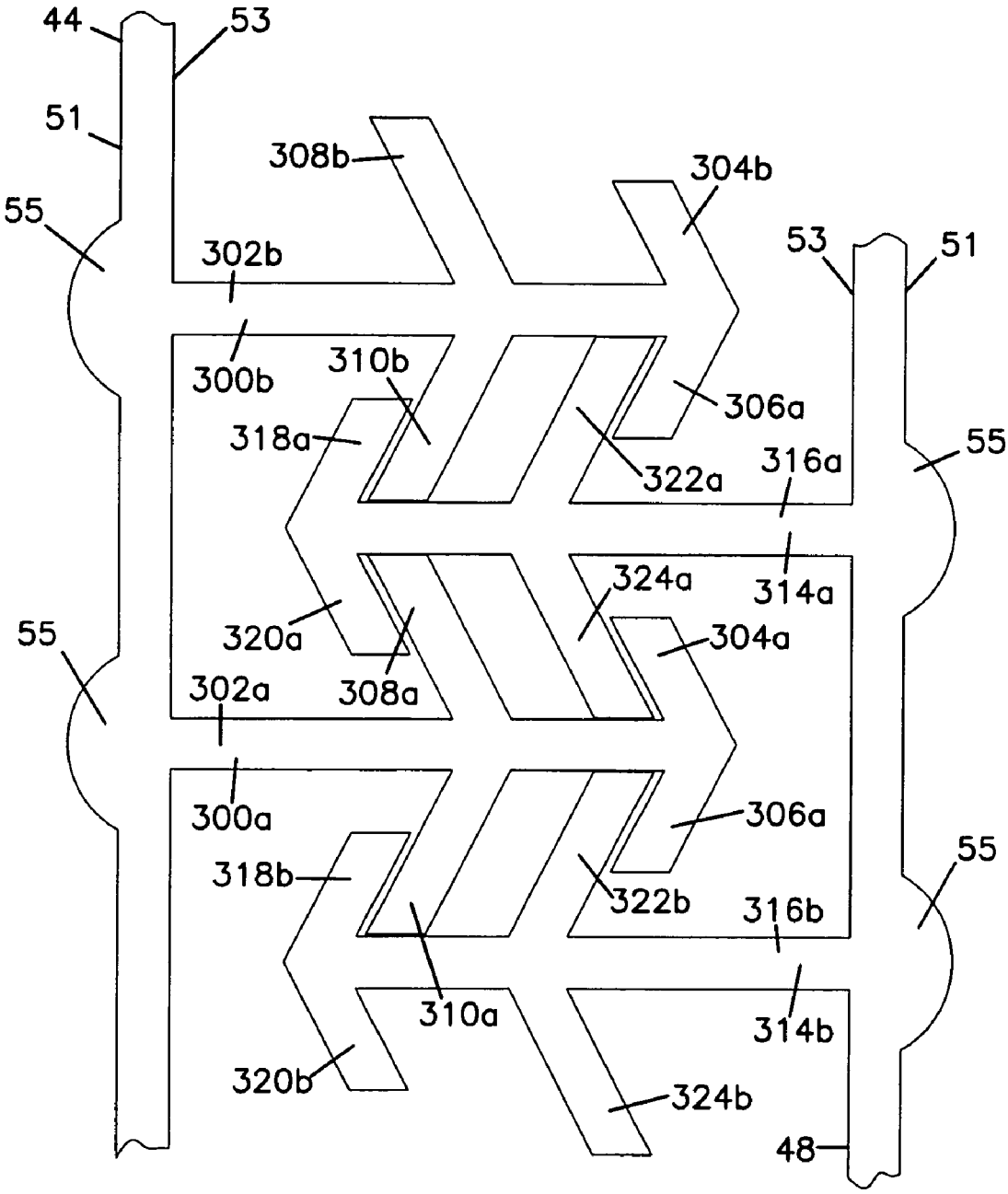
FIG. 11D is a cross-sectional view of an alternative embodiment of the zipper closure arrangement depicted in FIG. 11 in a second mated position.

In one embodiment of closure assembly 38 shown in FIGS. 11C and 11D, the plurality of first closure members 300 comprise at least a first leg 302*a*, further including feet 304*a*, 306*a*, 308*a*, and 310*a*, and a second leg 302*b*, further including feet 304*b*, 306*b*, 308*b*, and 310*b*. The plurality of second closure members 314 includes at least a first arm 316*a*, further including fingers 318*a*, 320*a*, 322*a*, and 324*a*, and a second arm 316*b*, further including fingers 318*b*, 320*b*, 322*b*, and 324*b*. In this embodiment, the first mated position (FIG. 11C) includes: (i) at least one of the first closure members 300, such as first leg 302*a* being oriented between first and second arms 316*a*, 316*b*; (ii) the second leg first foot 306*b* being between the first arm first finger 318*a* and first arm second finger 322*a*; (iii) the first leg first foot 304*a* being between the first arm first finger 320*a* and the first arm second finger 324*a*; and (iv) the first leg second foot 306*a* being between the second arm first finger 318*b* and the second arm second finger 322*b*. In this embodiment, the second mated position (FIG. 11D) includes: (i) at least one of the first closure members 300, as first leg 302*a* being oriented between first and second arms 316*a*, 316*b*; (ii) the second leg second foot 310*b* being between the first arm first finger 318*a* and first arm second finger 322*a*; (iii) the first leg second foot 308*a* being between the first arm first finger 320*a* and first arm second finger 324*a*; and (iv) the first leg second foot 310*a* being between the second arm first finger 318*b* and the second arm second finger 322*b*.

Figure 11E:
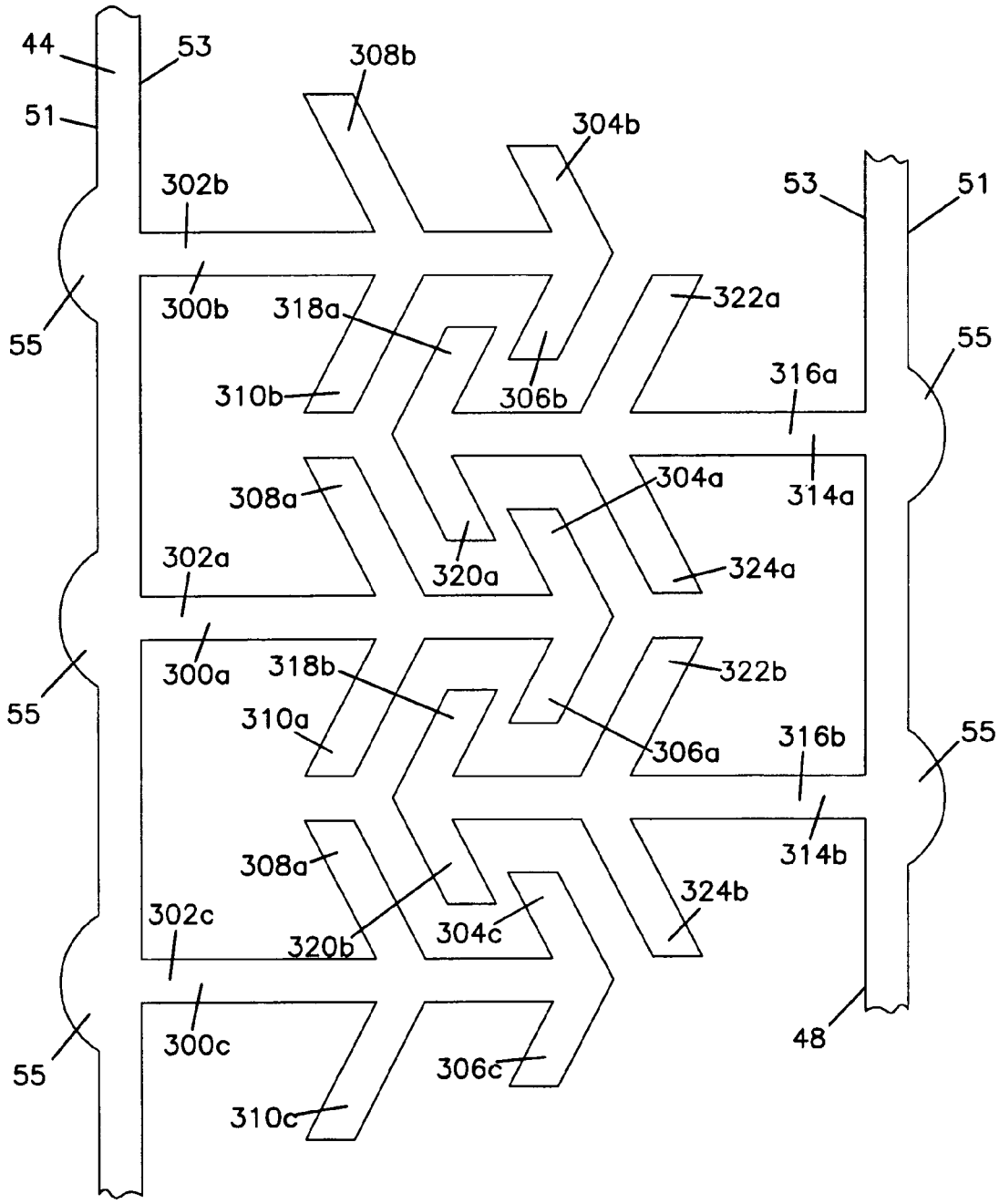
FIG. 11E is a cross-sectional view of the zipper closure arrangement depicted in FIG. 11 in a first mated position.
Figure 11F:
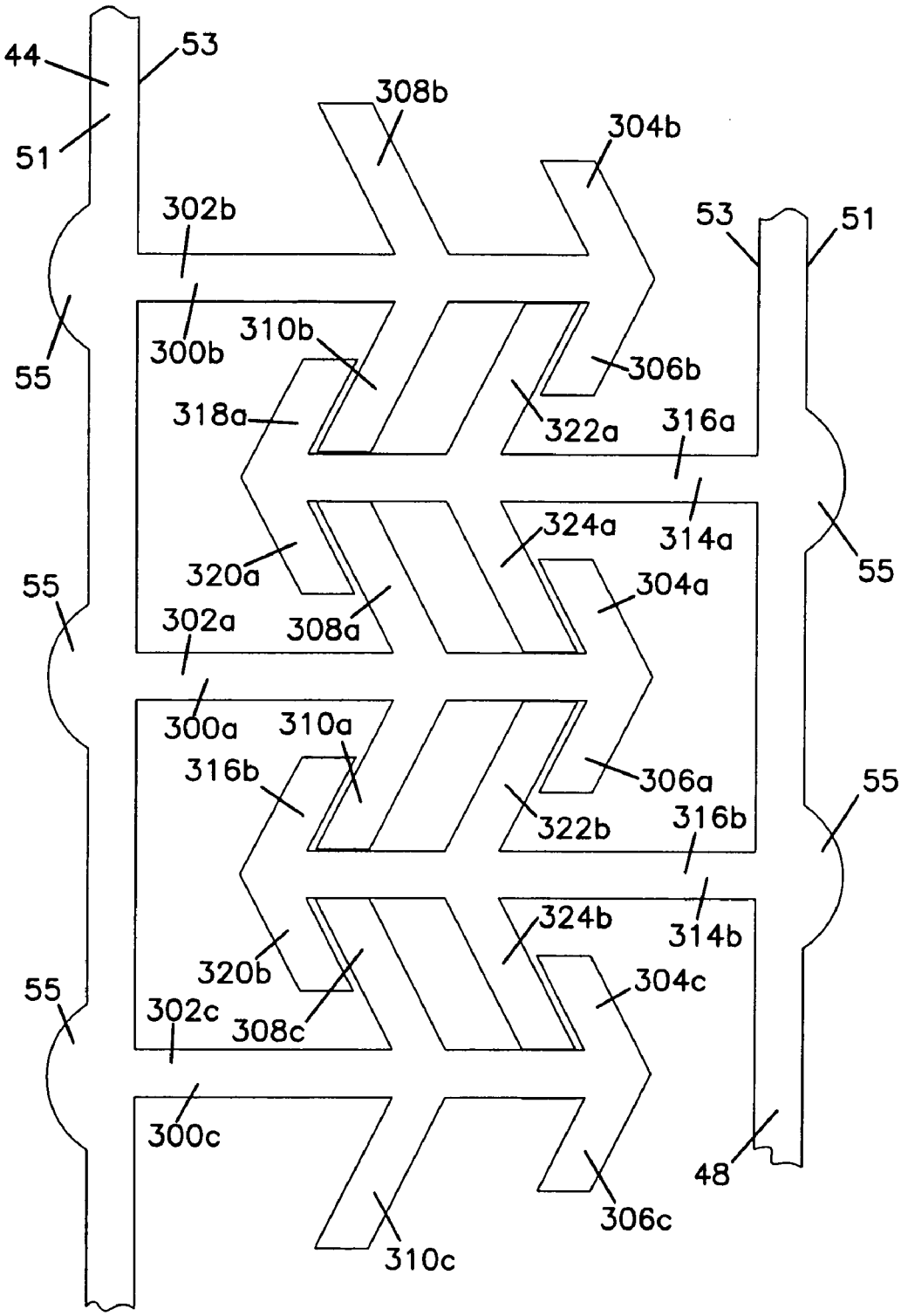
FIG. 11F is a cross-sectional view of the zipper closure arrangement depicted in FIG. 11 in a second mated position.

In another embodiment shown in FIGS. 11E and 11F, the plurality of first closure members further includes at least a third leg 302*c*, further including first feet 304*c*, 306*c*, and second feet 308*c*, 310*c*. In this embodiment, the first mated position (FIG. 11E) includes: (i) at least one of the first closure members 300, such as first leg 302*a* being oriented between first and second arms 316*a*, 316*b*; (ii) at least one of the second closure members 314, such as second arm 316*b* being oriented between first and third legs 302*a*, 302*c*; (iii) the second leg first foot 306*b* being between the first arm first finger 418*a* and first arm second finger 322*a*; (iv) the first leg first foot 304*a* being between the first arm first finger 320*a* and the first arm second finger 324*a*; (v) the first leg second foot 306*a* being between the second arm first finger 318*b* and the second arm second finger 322*b*; and (vi) the third leg first foot 304*c* being between the second arm first finger 320*b* and the second arm second finger 324*b*. In this embodiment, the second mated position (FIG. 11F) includes: (i) at least one of the first closure members 300, as first leg 302*a* being oriented between first and second arms 316*a*, 316*b*; (ii) at least one of the second closure members 314, such as second arm 316*b*, being oriented between the first and third legs 302*a*, 302*c*; (iii) the second leg second foot 310*b* being between the first arm first finger 318*a* and first arm second finger 322*a*; (iv) the first leg second foot 308*a* being between the first arm first finger 320*a* and first arm second finger 324*a*; (v) the first leg second foot 310*a* being between the second arm first finger 318*b* and the second arm second finger 322*b*; and (vi) the third leg second foot 308*c* being between the second arm first finger 320*b* and the second arm second finger 324*b*.

Figure 12:
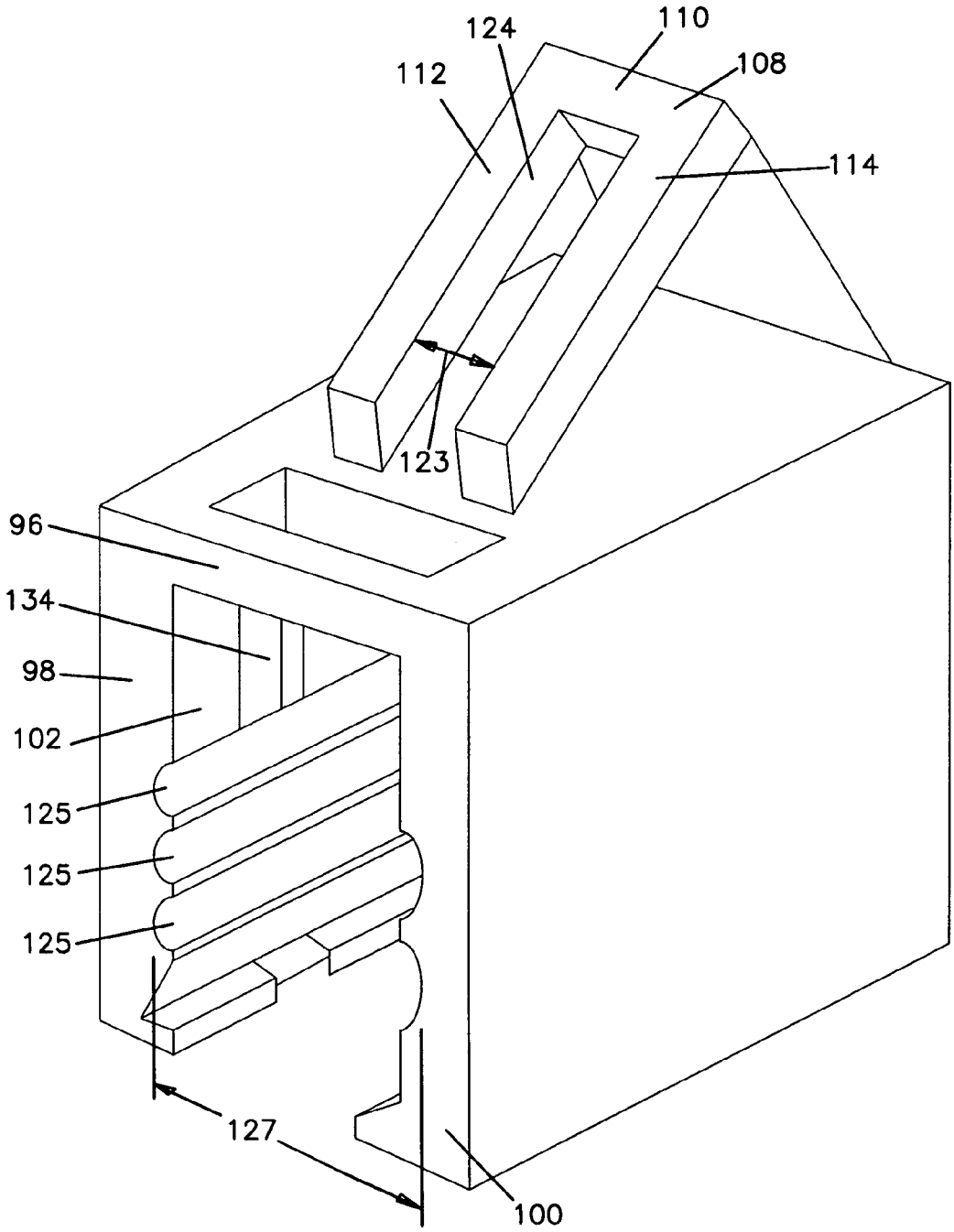
FIG. 12 is a perspective view of the slider depicted in FIG. 9 with a clip in a first, inoperative position.

Closure assembly 38 includes slider device 40. Slider device 40 is constructed to selectively squeeze one or more of first and second closures 46, 50 through exterior surfaces 51. Slider device 40 is oriented to slide laterally along the zipper closure arrangement 42, as indicated by directions A and B in FIG. 10. A perspective view of one useable embodiment of a slider device 40 is shown in FIG. 12. In the embodiment shown in FIG. 12, slider device 40 includes a top wall 96 oriented to slide along a top of the zipper closure arrangement 38, a first sidewall 98 depending from the top wall 96 oriented to slide along a side of the zipper closure arrangement 38, and a second sidewall 100 depending from the top wall 96 oriented to slide laterally along a side of the zipper closure arrangement 42 in directions A and B indicated in FIG. 10. Together, the top wall 96, first sidewall 98, and second sidewall 100 define a cavity 102 to operatively receive the zipper closure arrangement 42 therein. Slider device 40 further includes a clip 108 that is secured to at least one of the top wall 96, first sidewall 98, and second sidewall 100. Clip 108 is movable from a first position to a second position, in directions C and D indicated in FIG. 10. The first position includes the clip 108 being remote from the zipper closure arrangement 42. The second position includes the clip 108 being oriented to operatively engage the zipper closure arrangement 42.

Many embodiments of clip 108 are possible. A perspective view of one embodiment of clip 108 is shown in FIG. 12. In the embodiment depicted in FIG. 12, clip 108 includes a first wall 110, a first leg 112 depending from the first wall 110, and a second leg 114 depending from the first wall 110. The embodiment shown in FIG. 12 depicts the clip 108 secured to the top wall 96. A living hinge 116 is depicted in this embodiment as securing the top wall 96 of the slider device 40 to the clip first wall 110.

In the embodiment shown, top wall 96 of slider device 40 includes an aperture or opening 118 extending through top wall 96. Opening 118 is sized or dimensioned to allow the first and second legs 112, 114 of clip 108 to move through the cavity 102. First sidewall 98 of slider device 40 defines a first groove 134 sized to receive first leg 112 of clip 108. Second sidewall 100 of slider device 40 defines a second groove 136 sized to receive second leg 114 of clip 108.

Figure 13:
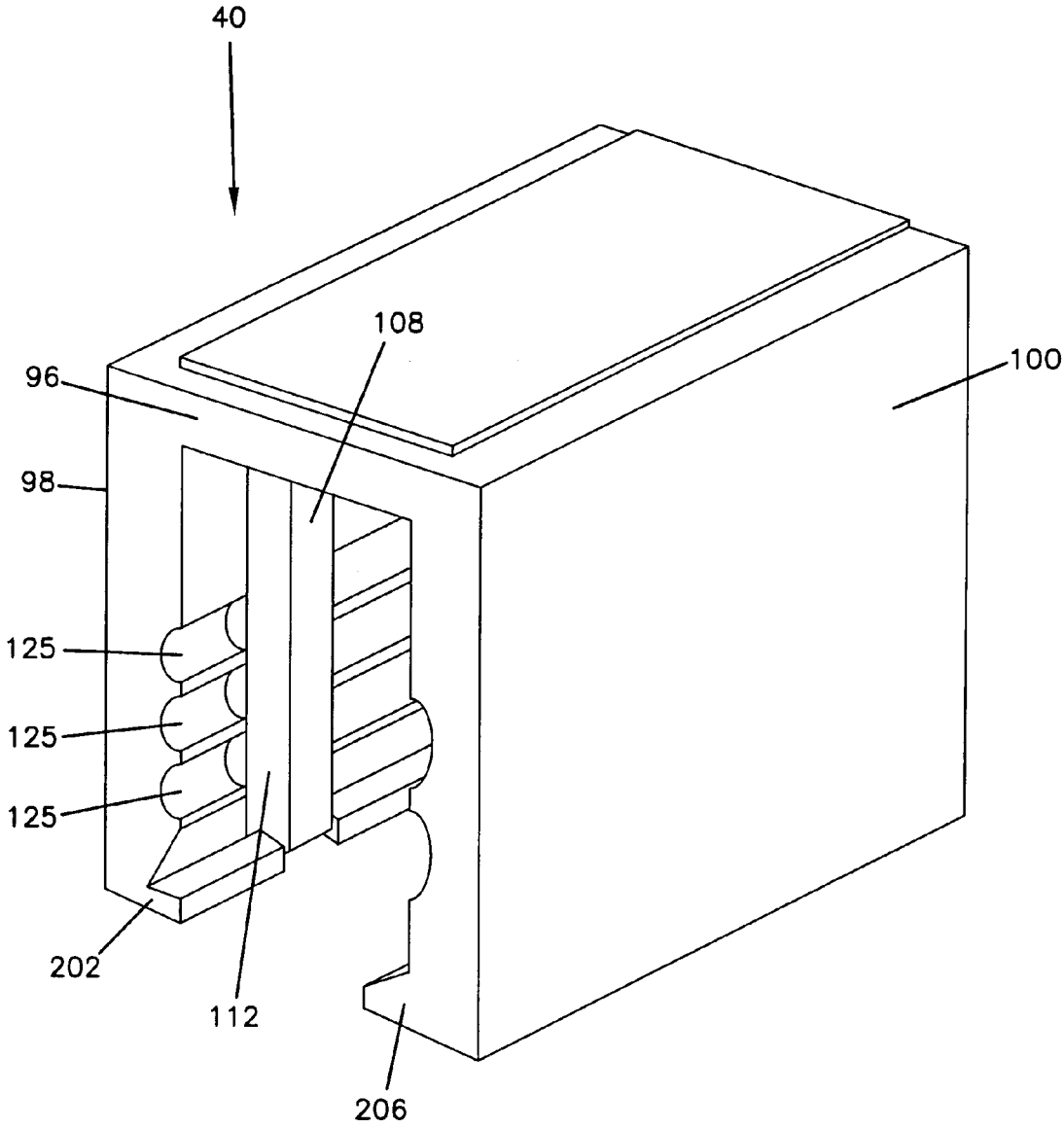
FIG. 13 is a perspective view of the slider depicted in FIG. 9 with a clip in a second, operative position.

Clip 108 is moveable from a first position, as shown in FIG. 12, wherein the clip 108 is inoperative, to a second position, as shown in FIG. 13, wherein the clip 108 is operatively oriented to engage the zipper closure arrangement 42. In the embodiment shown in FIG. 12, in the first position of clip 108, the first and second legs 112, 114 are outside of opening 118, and the clip first wall 110 is angled relative to the top wall 96. As shown in FIG. 13, when the clip 108 is in the second position, the first and second legs 112, 114 are at least partially inside of cavity 102 and pressed against the second closure, and clip first wall 110 is against top wall 96. In particular, in the illustrated embodiment, the first and second legs 112, 114 are substantially all the way inside of cavity 102, and the clip first wall 110 is against top wall 96. Clip 108 is brought to the second position by moving clip 108 through opening 118 in top wall 96.

In one embodiment, first and second walls 98, 100 of slider 40 define a plurality of grooves 125 that define a plurality of first zipper squeezing regions 127. The first zipper squeezing regions 127 are sized to apply sufficient pressure to protrusions 55 when the slider 40 is slid along the zipper closure arrangement 42 to cause the first and second zipper profiles 44, 48 to enter the first mated position. Further, first and second sidewalls 112, 114 of clip 108 define a second width 123 therebetween that defines a second zipper squeezing region 129. The second zipper squeezing region 129 is sized to apply sufficient pressure to protrusions 55 when the slider 40 is slid along the zipper closure arrangement 42 to cause the first and second zipper profiles 44, 48 to enter the second mated position.

Figure 14:
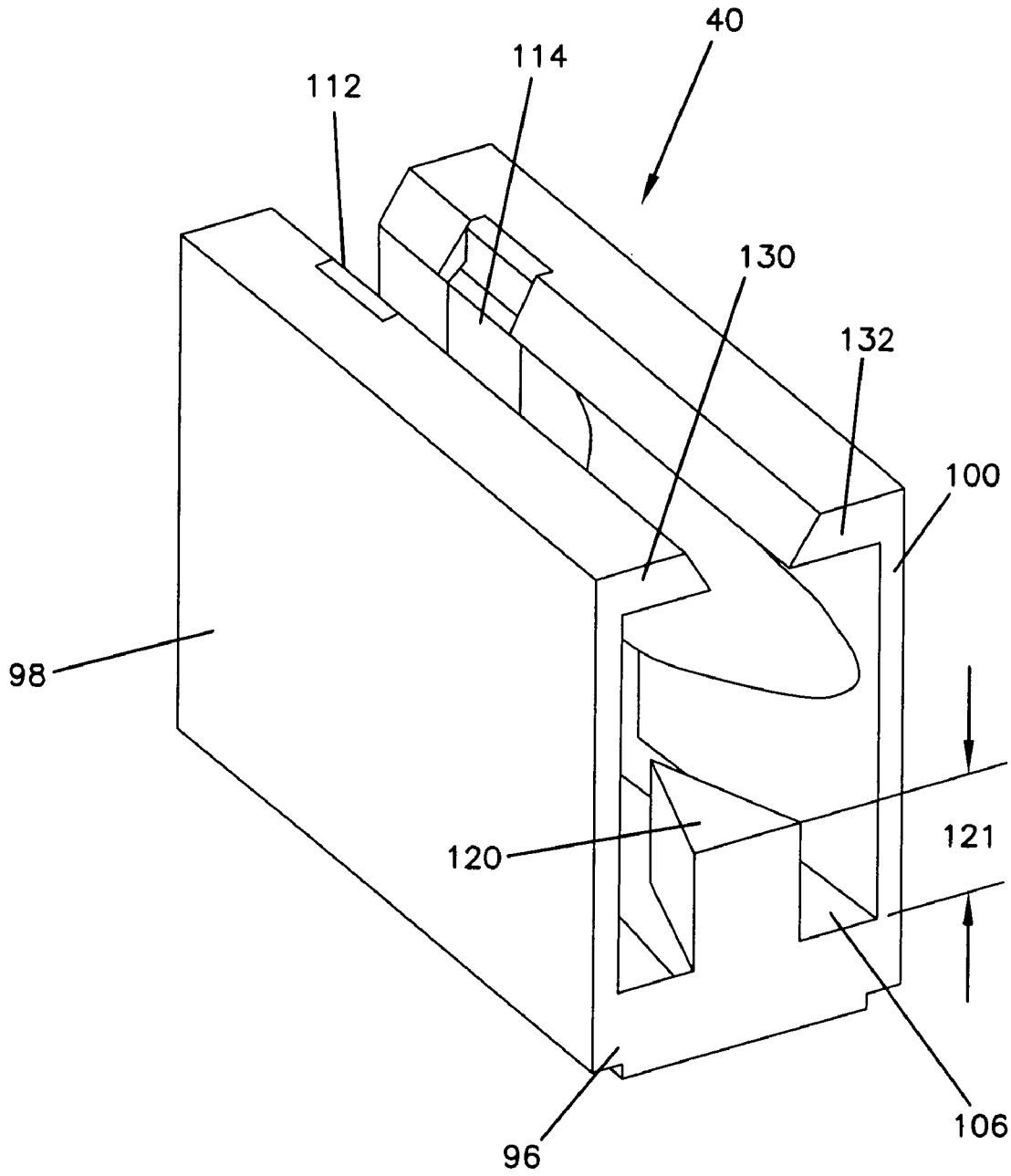
FIG. 14 is an alternative perspective view of the slider depicted in FIG. 9.

In some embodiments, slider device 40 includes a plow or splitter 120. Splitter 120 is constructed and arranged to at least partially separate the zipper closure arrangement 42 when the slider device 40 is slid along the zipper closure arrangement 42. One embodiment of a splitter 120 is depicted in FIG. 14. The depicted splitter 120 depends from interior surface 106 of top wall 96, and is generally wedge-shaped. Splitter 120 is characterized by a splitter depth 121, defined as the distance that splitter 120 protrudes away from surface interior surface 106. Splitter depth 121 is sized so that splitter 120 does not contact first or second closures 46, 50. The splitter 120 is constructed and arranged to separate the first closure 46 when the slider device 40 is moved laterally along the zipper closure arrangement 42 in a second direction opposite of the first direction, such as in direction B in FIG. 10 by applying force in a separating direction to interior surfaces 53. Splitter 120 is configured to not apply sufficient separating force to separate second closure 50 when slider device 40 is moved along zipper closure arrangement 42 in the second direction.

In use, a user effects the first mated position by grasping slider 40 with clip 108 in the first position and sliding slider 40 laterally along zipper closure arrangement 42 in first direction A, causing squeezing pressure to be applied from grooves 125 in side walls 98, 100 of slider 40 to protrusions 55 of first and second zipper profiles. The squeezing pressure applied is sufficient to cause the first closure 46 to mate in the first mated position. To enter the first mated position, each of first foot 306*b* and first finger 318*a*, and first foot 304*a* and first finger 320*a*, and first foot 306*a* and first finger 318*b* must deform and slide past each other. Typically, because first pair of feet 304, 306 and first pair of fingers 318, 320 are less stiff than the second pair of feet 308, 310 and second pair of fingers 322, 324, a force that is sufficient to cause the zipper closure arrangement 42 to enter the first mated position will be insufficient to cause the zipper closure arrangement 42 to enter the second mated position.

A user may unmate first closure 46 from the first mated position by grasping slider 40 with clip 108 in the first position and sliding it laterally along zipper closure arrangement 42 in direction B. Splitter 120 applies a separating force to interior surfaces 53 of first and second zipper profiles 46, 50 that is sufficient to unmate first closure 46. Alternatively, a user may unmate first closure 46 by grasping closure assembly 38 and manually applying sufficient force in a separating direction.

The second mated position is effected by first grasping clip 108 and placing it in the second position, through opening 118 and within first and second grooves 134, 136. The user then grasps slider 40 and slides it laterally along zipper closure arrangement 42 in either first direction A or second direction B, causing squeezing pressure to be applied from second squeezing region 129 of clip 108 to protrusions 55 of first and second zipper profiles 44, 48. The squeezing pressure applied is sufficient to cause both the first closure 46 to mate in the first mated position and the second closure 50 to mate in the second mated position. In the embodiment depicted in FIGS. 11E and 11F, entering the second mated position requires: (i) second foot 310*b* and first finger 318*a* must deform and slide past each other; (ii) first foot 306*b* and second finger 322*a* must deform and slide past each other; (iii) second foot 308*a* and first finger 320*a* must deform and slide past each other; (iv) first foot 304*a* and second finger 324*a* must deform and slide past each other; (v) first foot 306*a* and second finger 322*b* must deform and slide past each other; (vi) first foot 304*c* and second finger 324*b* must deform and slide past each other; (vii) second foot 310*b* and first finger 318*a* must deform and slide past each other; (viii) second foot 308*a* and first finger 320*a* must deform and slide past each other; (ix) second foot 310*a* and first finger 318*b* must deform and slide past each other; and (x) second foot 308*c* and first finger 320*b* must deform and slide past each other. Because second pairs of feet 308, 310, and second pairs of fingers 322, 324 are relatively stiff, once zipper closure arrangement 42 is in the second mated position, it cannot readily be unmated. In addition, once zipper closure arrangement 42 is in the second mated position, slider 40 may be removed from closure 38.

Example 4

In another aspect, a method of using a package 20 is disclosed. Referring to FIG. 1, package 20 includes a surrounding wall 34 defining an interior volume 30, a mouth 36, and a closure assembly 38 oriented at the mouth 36. The closure assembly 38 includes a zipper closure arrangement 42 and a slider device 40 operably oriented on the zipper closure arrangement 42. The zipper closure arrangement 42 includes a first zipper profile 44 and a second zipper profile 48, which define a first closure 46 and a second closure 50. First and second closures 46, 50 are constructed and arranged to selectively interlock. In one embodiment, second closure 50 cannot be unmated after being mated.

In one embodiment, the method includes the steps of grasping slider device 40 and pushing slider device 40 axially relative to the zipper closure arrangement 42, such as in direction D in FIG. 2, to engage the slider device 40 against the zipper closure arrangement 42, where the zipper closure arrangement 42 includes a first closure 46 and a second closure 50. In the embodiment shown in FIG. 2, slider device includes an end 200 with a foot 202 and an end 204 with a foot 206. Further, the zipper closure arrangement includes first and second externally directed projections 212, 214. Pushing the slider device 40 axially relative to the zipper closure arrangement 42 causes feet 202, 206 to move over and beyond projections 212, 214. The method further includes the step of moving the slider device 40 laterally in a first direction to close the first closure 46 and to permanently close the second closure 50. The slider 40 has zipper squeezing surfaces 124, which apply a compressive or squeezing force to both the first and second zipper profiles 44, 48 when the slider device 40 is slid along the zipper closure arrangement 42. The squeezing force is sufficient to cause second closure 50 to mate, which in one embodiment cannot be unmated after being mated.

In another embodiment of the method, before the step of pushing the slider device 40 axially relative to the zipper closure arrangement, the method includes the step of moving the slider device 40 laterally in the first direction, such as in direction A in FIG. 2, to close only the first closure 46 and not to close the second closure 50. In the embodiment depicted in FIG. 2, before pushing the slider device 40 relative to the zipper closure arrangement 42, the feet 202, 206 of slider 40 are positioned in grooves 208, 210 along the first and second zipper profiles 44, 48. When the slider device 40 is in this position, the zipper squeezing surfaces 124 are proximate to the first closure 46 and not proximate to second closure 50. When the slider 40 is moved laterally in the first direction, a squeezing or compression force is applied only to first closure 46, only closing first closure 46 and not second closure 50.

In a further embodiment of the method, after the step of moving the slider device 40 laterally in the first direction to close only the first closure 46 and not to close the second closure 50 and before the step of pushing the slider device 40 axially, the slider device 40 is moved laterally in a second direction opposite of the first direction, such as direction B shown in FIG. 2, to open the first closure 46. In one embodiment, slider 40 includes a wedge-shaped splitter 120 that is arranged to contact interior surfaces 53 of the first and second zipper profiles 44, 48. When the slider 40 is moved in a direction such as direction B shown in FIG. 2, splitter 120 applies a separating force to interior surfaces 53, causing the first closure 46 to become unmated.

Example 5

In another aspect, a method of using a package 20 is disclosed. Referring to FIG. 9, package 20 includes a package surrounding wall 34 defining an interior volume 30, a mouth 36, and a closure assembly 38 oriented at the mouth 36; the closure assembly 38 including a zipper closure arrangement 42 and a slider device 40 operably oriented on the zipper closure arrangement 42. The zipper closure arrangement includes a first zipper profile 44 and a second zipper profile 48, which define a first closure 46 and a second closure 50. First closure 46 and second closure 50 are constructed and arranged to selectively interlock. The zipper closure arrangement 42 includes a first mated position and a second mated position. First closure 46 is defined by a first mated position of zipper closure arrangement 42, and second closure 50 is defined by a second mated position of zipper closure arrangement 42. In one embodiment, first closure 46 is a reclosable closure and second closure 50 is a closure that cannot readily be unmated once it has been mated. The slider device 40 includes zipper squeezing surfaces, such as zipper squeezing surfaces 127 shown in FIG. 12. Slider device 40 also includes a clip 108 movable from a first position to a second position. In the embodiment shown in FIG. 12, clip 108 includes a pair of legs 112, 114 which define a zipper squeezing region 124 therebetween. In the embodiment shown in FIG. 9, when clip 108 is in the first position, clip 108 is not in contact with the zipper closure arrangement 42. In the embodiment shown in FIG. 13, when clip 108 is in the second position, the legs 112, 114 are positioned so that zipper squeezing region 124 will contact the zipper closure arrangement 42.

The method includes the step of grasping the slider device 40, with the clip 108 in the second position and the zipper closure arrangement in the first mated position, and moving the slider device 40 laterally in a first direction, such as direction A shown in FIG. 10, to move the zipper closure arrangement 42 from the first mated position to the second mated position. When slider device 40 is moved in the first direction, the zipper squeezing surfaces 124 of clip 108 apply a squeezing or compression force to the first and second zipper profiles 44, 48, causing the zipper closure arrangement 42 to enter the second mated position from the first mated position. The squeezing force applied by the zipper squeezing surfaces 127 is sufficient to cause the zipper closure arrangement 42 to enter the second mated position.

In another aspect of the method, before the step of moving the slider device 40 laterally in a first direction, such as direction A in FIG. 10, to move the zipper closure arrangement 42 from the first mated position to the second mated position, the method includes the step of moving the clip 108 from the first position to the second position.

In another aspect of the method, before the step of moving the clip 108 from the first position to the second position, the method includes the step of moving the slider device 40 laterally in a first direction, such as direction A in FIG. 10, to move the zipper closure arrangement 42 to the first mated position. When the clip 108 is in the first position and the slider device 40 is moved laterally in the first direction, the zipper squeezing surfaces 127 of slider 40 apply a squeezing or compressive force to zipper closure arrangement 42 to cause zipper closure arrangement 42 to enter the first mated position. The squeezing force applied by surfaces 127 is insufficient, however, to cause zipper closure arrangement to enter the second mated position.

In yet another aspect of the method, before the step of moving the clip 108 from the first position to the second position, the method includes the step of moving the slider device 40 laterally in a second direction, such as direction B shown in FIG. 10 to unmate the zipper closure arrangement 42 from the first mated position. In one embodiment, slider 40 includes a wedge-shaped splitter 120 that is arranged to contact interior surfaces 53 of the first and second zipper profiles 44, 48. When the slider 40 is moved in a direction such as direction B shown in FIG. 10, splitter 120 applies a separating force to interior surfaces 53, causing the first closure 46 to become unmated.

We claim:

1. A closure assembly for use with a flexible package; the closure assembly comprising:
- (a) a zipper closure arrangement having first and second zipper profiles constructed and arranged to selectively interlock; the zipper closure arrangement including first and second closures defined by the first and second zipper profiles;
- (b) a slider device oriented to slide laterally along the zipper closure arrangement and oriented to be axially moveable from a first axial position to a second axial position;
  - (i) the first closure being constructed and arranged to mate when the slider device is in the first axial position and is moved laterally along the zipper closure arrangement in a first direction; and
  - (ii) the second closure being constructed and arranged to mate when the slider device is in the second axial position and is moved laterally along the zipper closure arrangement in the first direction; the second closure being constructed and arranged to be unmated when the slider device is in the first axial position.

2. A closure assembly according to claim 1 wherein:
- (a) the slider device includes:
  - (i) a top wall oriented to slide along a top of the zipper closure arrangement;
  - (ii) a first sidewall depending from the top wall oriented to slide along a side of the zipper closure arrangement; and
  - (iii) a second sidewall depending from the top wall oriented to slide along a side of the zipper closure arrangement; and
    - (A) the top wall, first sidewall, and second sidewall defining a cavity to operatively receive the zipper closure arrangement therein.

3. A closure assembly according to claim 2 wherein:
- (a) the slider device further includes a splitter depending from the top wall; the splitter being constructed and arranged to separate the first closure when the slider device is moved laterally along the zipper closure arrangement in a second direction opposite of the first direction.

4. A closure assembly according to claim 3 wherein:
- (a) the splitter and the second closure are oriented so that the second closure is not separated by the splitter, when the slider device is in the first axial position and when moved along the zipper closure arrangement in the second direction.

5. A closure assembly according to claim 2 wherein:
- (a) the first sidewall defines an end with a foot;
- (b) the second sidewall defines an end with a foot;
- (c) the zipper closure arrangement defines a first external groove in the first zipper profile and a second external groove in the second zipper profile;
  - (i) the first and second external grooves being located between the first closure and second closure; and
- (d) the first axial position of the slider device includes the first sidewall foot being seated in the first groove, and the second sidewall foot being seated in the second groove.

6. A closure assembly according to claim 5 wherein:
- (a) the zipper closure arrangement includes a first externally directed projection in the first zipper profile and a second externally directed projection in the second zipper profile;
  - (i) the second closure being located between the first and second externally directed projections and the first closure; and
- (b) the second axial position includes:
  - (i) the first projection being between the first sidewall foot and the second closure; and
  - (ii) the second projection being between the second sidewall foot and the second closure.

7. A closure assembly according to claim 1 wherein:
- (a) the second closure includes the first zipper profile having:
  - (i) a first closure member having a neck terminating with a head wider than the neck;
  - (ii) a first arm terminating with a finger; and
  - (iii) a second arm terminating with a finger;
    - (A) the first closure member being between the first arm and second arm;
- (b) the second closure includes the second zipper profile having:

(i) a first leg terminating with a pair of hooks; and
(ii) a second leg terminating with a pair of hooks;
(c) the second closure, in a mated position, includes:
(i) the first leg being between the first arm and the first closure member; the first leg pair of hooks engaging the head and the first arm finger; and
(ii) the second leg being between the second arm and the first closure member; the second leg pair of hooks engaging the head and the second arm finger.

8. A closure assembly according to claim 1 wherein:
(a) the first closure includes a first hooked profile member on the first zipper profile;
(b) the first closure includes a second hooked profile member on the second zipper profile;
(i) the first and second hooked profile members being constructed and arranged to selectively mate and separate.

9. A closure assembly according to claim 8 wherein:
(a) the first closure further includes a first closure post on the second zipper profile adjacent to the first hooked profile member;
(i) the first hooked profile member being received within a gap between the first closure post and the second hooked profile member, when the first and second hooked profile members are mated.

10. A closure assembly for use with a flexible package; the closure assembly comprising:
(a) a zipper closure arrangement having first and second zipper profiles constructed and arranged to selectively interlock into first and second mated positions;
(i) the first mated position including the first and second zipper profiles being interlocked and being capable of being selectively unmated; and
(ii) the second mated position including the first and second zipper profiles being interlocked and being incapable of being unmated without tampering being evident; and
(b) a slider device oriented to slide laterally along the zipper closure arrangement to move the zipper closure arrangement from the first mated position to the second mated position.

11. A closure assembly according to claim 10 wherein:
(a) the first zipper profile includes a plurality of first closure members; each of the first closure members including a leg with a first pair of feet at an end of the leg and a second pair of feet on the leg spaced from the first pair of feet; and
(b) the second zipper profile includes a plurality of second closure members; each of the second closure members including an arm with a first pair of fingers at an end of the arm and a second pair of fingers on the arm spaced from the first pair of fingers.

12. A closure assembly according to claim 11 wherein:
(a) the plurality of first closure members includes at least a first leg and a second leg;
(b) the plurality of second closure members includes at least a first arm and a second arm; and
(c) the first mated position includes at least the first leg being oriented between the first and second arms, the first leg first pair of feet being between:
(i) the first arm first pair of fingers and the first arm second pair of fingers; and
(ii) the second arm first pair of fingers and the second arm second pair of fingers.

13. A closure assembly according to claim 12 wherein:
(a) the plurality of first closure members further includes at least a third leg; and
(b) the first mated position includes the first arm being oriented between the first and second legs and the second arm being oriented between the second and third legs;
(i) the first arm first pair of fingers being between: the first leg first pair of feet and first leg second pair of feet, and the second leg first pair of feet and the second leg second pair of feet; and
(ii) the second arm first pair of fingers being between: the second leg first pair of feet and the second leg second pair of feet, and the third leg first pair of feet and the third leg second pair of feet.

14. A closure assembly according to claim 13 wherein:
(a) the second mated position includes the first arm being oriented between the first and second legs and the second arm being oriented between the second and third legs;
(i) the first arm second pair of fingers being between: the first leg first pair of feet and first leg second pair of feet, and the second leg first pair of feet and the second leg second pair of feet;
(ii) the second arm second pair of fingers being between: the second leg first pair of feet and the second leg second pair of feet, and the third leg first pair of feet and the third leg second pair of feet; and
(iii) the second leg second pair of feet being between: the first arm first pair of fingers and the first arm second pair of fingers, and the second arm first pair of fingers and the second arm second pair of fingers.

15. A closure assembly according to claim 11 wherein:
(a) each of the first closure member first and second pairs of feet being arrow-shaped; and
(b) each of the second closure member first and second pairs of fingers being arrow-shaped.

16. A closure assembly according to claim 11 wherein:
(a) the slider device includes:
(i) a top wall oriented to slide along a top of the zipper closure arrangement;
(ii) a first sidewall depending from the top wall oriented to slide along a side of the zipper closure arrangement;
(iii) a second sidewall depending from the top wall oriented to slide along a side of the zipper closure arrangement;
(A) the top wall, first sidewall, and second sidewall defining a cavity to operatively receive the zipper closure arrangement therein; and
(iv) a clip secured to at least one of the top wall, first sidewall, and second sidewall; the clip being moveable from a first position to a second position;
(A) the first position including the clip being remote from the zipper closure arrangement; and
(B) the second position including the clip being oriented to operatively engage the zipper closure arrangement.

17. A closure assembly according to claim 16 wherein:
(a) the zipper closure arrangement is constructed and arranged to move to the first mated position when the slider device is moved along the zipper closure arrangement in a first direction; and
(b) the zipper closure arrangement is constructed and arranged to move to the second mated position when the slider device is moved along the zipper closure arrangement in the first direction and when the clip is in the second position.

18. A closure assembly according to claim 17 wherein:

(a) the slider device further includes a splitter depending from the top wall; the splitter being constructed and arranged to separate the zipper closure arrangement from the first mated position to an unmated position when the slider device is moved along the zipper closure arrangement in a second direction opposite of the first direction.

19. A closure assembly according to claim 18 wherein:

(a) the clip includes a first wall, a first leg depending from the first wall, and a second leg depending from the first wall.

20. A closure assembly according to claim 19 wherein:

(a) the clip is secured to the top wall.

21. A closure assembly according to claim 20 further comprising:

(a) a living hinge between the clip first wall and top wall to secure the clip to the top wall.

22. A closure assembly according to claim 21 wherein:

(a) the first position of the clip includes:

(i) the first and second legs being outside of the cavity; and (ii) the clip first wall being angled relative to the top wall; and (b) the second position of the clip includes:

(i) the first and second legs being at least partially inside of the cavity and pressed against the second closure; and (ii) the clip first wall being against the top wall.

23. A closure assembly according to claim 22 wherein:

(a) the top wall defines an opening; and (b) the first and second legs are movable through the opening to move the clip from the first position to the second position.

24. A closure assembly according to claim 23 wherein:

(a) the first and second sidewalls define:

(i) a first width therebetween to define a zipper squeezing region; the first width being sized to cause the first and second sidewalls to move the zipper closure arrangement to the first mated position; and (ii) a second width therebetween to define a zipper non-squeezing region; the second width being sized greater than the first distance and to not cause the first and second sidewalls to move the zipper closure arrangement to the second mated position.

* * * * *